United States Patent [19]

Evans et al.

[11] 4,250,476

[45] Feb. 10, 1981

[54] AUXILIARY SWITCH FOR INDICATING THE CONDITION OF A CIRCUIT-INTERRUPTING DEVICE

[75] Inventors: David M. Evans, Palatine; Richard J. Sabis, Chicago, both of Ill.

[73] Assignee: S & C Electric Company, Chicago, Ill.

[21] Appl. No.: 93,668

[22] Filed: Nov. 13, 1979

[51] Int. Cl.[3] ..... H01H 9/16

[52] U.S. Cl. ..... 335/17; 200/308; 200/310; 200/48 R; 340/638

[58] Field of Search ..... 335/17; 200/308, 310, 200/48 R; 340/638

[56] References Cited

U.S. PATENT DOCUMENTS

| | | | |
|---|---|---|---|
| 2,777,024 | 1/1957 | West | 200/308 |
| 2,803,967 | 8/1957 | Curtis | 200/308 |
| 3,324,258 | 6/1967 | Foti et al. | 200/48 R |
| 3,742,402 | 6/1973 | Nicol et al. | 335/17 |
| 4,135,072 | 1/1979 | Maier et al. | 200/308 |
| 4,166,989 | 9/1979 | Castongnay | 335/17 |

*Primary Examiner*—John W. Shepperd

*Attorney, Agent, or Firm*—John D. Kaufmann

[57] ABSTRACT

An indicator is disclosed for a high voltage circuit interrupter having a stored-energy mechanism for biasing the contacts open.

The interrupter has a shunt trip mechanism to open the contacts in response to either circuit conditions or a remote command, and a manual mechanism to trip the store-energy mechanism and to recharge and reset the store-energy mechanism. The indicator mimics the operation of the circuit interrupter and provide three signals indicating that the contacts are closed and the manual mechanism are between home and trip position, that the contacts open and the manual mechanism is either in the home or trip position, and that the contacts are open and the manual mechanism is between the trip and reset position or at the reset position. The indicators are preferably two lights with either light on or with both lights out.

20 Claims, 9 Drawing Figures

12
14
16
18
50
46
52
26
32
24
33
30
28
37
34
36
44
42
48
112
10
116
114
40
20
38
22

194
204
202
186
200
292
324
286
288
274
256
254
178
282
280
252
282
272
270
290
298
266
276
268
278
284
260
258
262
264
204

AUXILIARY SWITCH FOR INDICATING THE CONDITION OF A CIRCUIT-INTERRUPTING DEVICE

BACKGROUND OF THE INVENTION

1. Field of the Invention

This invention relates to an auxiliary switch for indicating the condition of a circuit-interrupting device, and more particularly, to an electro-mechanical switch which senses the condition of both a circuit-interrupting device and its operating mechanism and gives sensible information concerning the condition thereof so that an operator of the circuit-interrupting device can determine what action is required.

2. Description of the Prior Art

Various types of high-voltage circuit-interrupting devices are well known. Such devices include fuses, circuit breakers, and circuit-switchers. Circuit-switchers comprise a family of circuit-interrupting devices, each of which includes an interrupting unit.

The interrupting unit generally includes one or more pairs of interrupting contacts which are normally engaged to conduct current through the interrupting unit, but which may be rapidly separated. Such separation is generally effected in an arc-extinguishing environment, which typically includes a quantity of dielectric fluid, such as $SF_6$ gas. As the contacts separate to elongate the arc forming therebetween, such elongation and the action of the dielectric gas extinguish the arc to effect current interruption within the interrupting unit. Typically, the gas may be "puffed" at the arc to aid in this circuit interruption.

The contacts are rapidly separated by a stored-energy mechanism, which typically includes a robust spring which is normally compressed to bias the contacts to an open position. The stored-energy mechanism is normally latched to prevent the release if the energy stored in the spring and to maintain the contacts in their normal engaged condition. Typically in circuit-switchers, the latch may be operated to release the energy stored in the spring in response to one of two types of conditions. First, the energy may be released by operation of a "shunt trip" mechanism in response to the detection by appropriate sensors of untoward circuit conditions, such as overcurrents, fault currents, short-circuit currents, overpressure in a transformer, or improper differential currents. As an adjunct to such sensors, the shunt trip mechanism may also be operated by a remote operating switch, which causes the interrupting unit to interrupt magnetizing or normal current in the circuit. This latter operation of the circuit-interrupting device may be effected in order to perform maintenance on the circuit, on the device itself, or for any other reason requiring interruption of the circuit for reasons other than faults or the like.

The stored energy may also be released in typical circuit-switchers in response to manual manipulation of a manual operating mechanism associated with the stored-energy mechanism. Typically, and similar to the operation of the circuit-interrupting device in response to remote control signals in other than fault situations, it may be desirable to operate the interrupting device, and to therefore interrupt the circuit, by manual manipulation of the manual operating mechanism for reasons related to maintenance, repair, or testing of either the circuit or the circuit-interrupting device.

A species of circuit-switcher is a device in which the interrupting unit may be operated, as described above, but which may not be automatically reset; that is, may not have its interrupting contacts automatically reclosed following separation thereof. In this type of device, whether the interrupting contacts are separated or opened due to either operation of the latch by a remote sensor or by manipulation of the manual operating mechanism, the contacts may be re-engaged only by appropriate manipulation of the operating mechanism. Since the interrupting unit is of the type wherein, once the contacts are separated or opened, closure of those contacts automatically re-stores energy to the stored-energy mechanism as well as latches this mechanism against the release of energy, the above-referred-to manipulation of the manual operating mechanism involves the rotation of a handle or the like by a worker to reclose the contacts following the opening thereof. Such reclosure of the contacts, as already stated, restores energy to the stored-energy mechanism.

In a specific embodiment of this species of circuit switcher, the handle of the manual operating mechanism may be rotated from a "home" position to a "trip" position to release the stored energy and to thereby open the interrupting contacts. Further rotation of the handle, in the same direction, from the "trip" position to a "reset" position recloses the contacts and re-stores energy in the stored-energy mechanism. The return of the handle from the "reset" position to the "home" position has no effect on the interrupting contacts. If the interrupting contacts have been initially separated due to the operation of the shunt-trip device in response to the action of the remote sensors, the initial movement of the handle from the "home" position to the "trip" position has no effect on the open contacts; however, further rotation of the handle from the "trip" position to the "reset" position is still necessary to reclose the interrupting contacts.

The interrupting units of circuit-switchers and related devices generally have a contact-indicating mechanism thereon. This mechanism indicates whether the interrupting contacts are opened or closed. However, in many environments, these interrupting devices are mounted on pedestals or structures which elevate them substantially above the ground. This elevation often renders it quite difficult for a ground-level worker to accurately determine the condition—opened or closed—of the interrupting contacts. Since the interrupting contacts and the other internal structure of the interrupting units are totally enclosed within an opaque insulative housing, it therefore becomes imperative for the worker to be able to accurately determine the condition of the interrupting units of the circuit-interrupting device in order to determine what action, if any, is necessary. The auxiliary switch of the present invention makes such accurate determination of the condition of the circuit-interrupting device possible. The auxiliary switch of the present invention also permits other devices to operate or be operated in accordance with the condition of the interrupting unit of the device as will hereinafter be made clear.

SUMMARY OF THE INVENTION

According to the broadest aspects of the present invention, apparatus for involving the condition of an interrupting device is provided. The interrupting device is connectable to a high-voltage circuit. The interrupting device includes normally closed interrupting contacts which are openable to prevent current flow therethrough. A first, stored-energy mechanism biases the contacts open when they are closed, and re-stores contact-opening energy when the contacts are moved from open to closed. A second, shunt-trip mechanism operates in response to either electrical conditions of the circuit or a remote command to release the stored energy for opening the contacts. A third mechanism operates in response to manual movement thereof to release the stored energy for opening the contacts. The third mechanism also operates in response to manual movement thereof to close the contacts following opening thereof by either the second or third mechanism. Operation of the second or third mechanism does not affect the condition of the other mechanism.

The indicating apparatus includes facilities at ground potential which both mimic the putative condition of the contacts, depending on the condition of the second and third mechanisms, and also mimic the movement of the third mechanism. These facilities thereby indicate the condition of the interrupting device. The mimicing facilities comprise a first facility which responds to the lack of contact-opening operation of the second and third mechanisms for giving a first sensible indication that the contacts are putatively closed. A second facility responds to the contact-opening operation of either the second or third mechanism for giving a second sensible indication that the contacts are putatively open. Last, a third facility responds to contact-closing operation of the third mechanism for giving a third sensible indication that such operation is taking place. The third, manually-operable mechanism is movable out of a home position to a trip position in a first direction for releasing the stored energy to open the contacts. The third mechanism is further movable in the first direction from the trip position to a reset position to close the contacts following the opening thereof by either the second or third mechanism. Movement of the third mechanism in the second opposite direction back to its home position does not move the contacts. The first facility responds to the contacts being closed and to the third mechanism being in either its home position or between its home and trip position for giving the first sensible indication thereof. The second facility responds to two conditions. The first condition is that the contacts have been opened either by the second mechanism or by the third mechanism. The second condition is that the third mechanism is in either its home or its trip positions. When both of these conditions are present, the second facility gives the second sensible indication thereof. The third facility responds to the third mechanism being either between its trip and reset positions or at its reset position for giving the third sensible indication thereof.

In preferred embodiments, a fourth facility is also included. This fourth facility enables the second mechanism when the first sensible indication is given, but disables the second mechanism when the second or third indication is given.

DETAILED DESCRIPTION OF THE INVENTION

General

Figure 1:
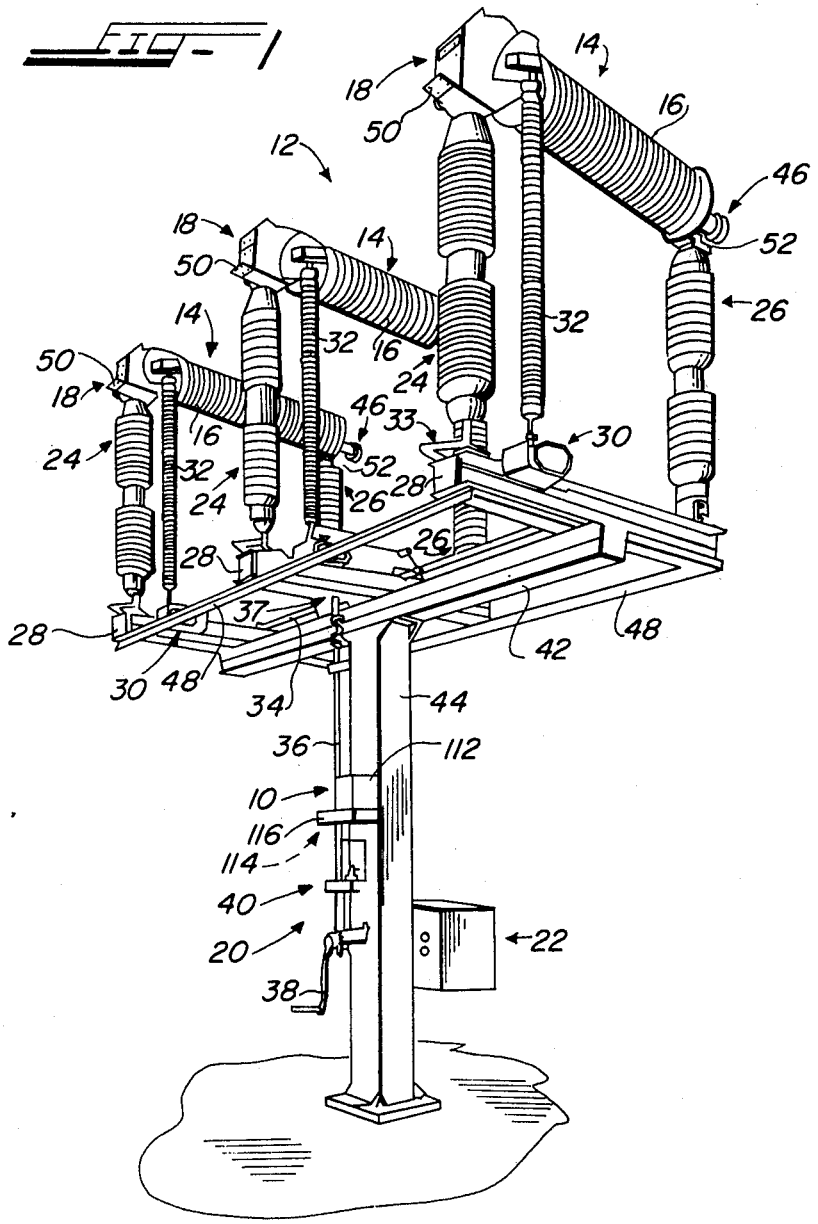
FIG. 1 is a perspective elevation of a circuit-interrupting device according to the principles of the present invention.

Referring first to FIG. 1, there is shown an auxiliary switch 10 at ground potential for indicating the condition of a circuit-interrupting device 12 at line potential in accordance with the principles of the present invention. The circuit-interrupting device 12 may, as illustrated, constitute a three-pole interrupting device 12 (where the circuit is a three-phase circuit) having no integral disconnect switches or isolating mechanism. The circuit-interrupting device 12 includes three interrupting units 14 which interrupt current to open the three-phase circuit to which the device is connected.

Each interrupting unit 14 is a puffer type of interrupter which includes one or more pairs of normally closed or engaged, separable interrupting contacts (not shown). Each interrupting unit 14 includes an insulative housing 16 which contains the interrupting contacts as well as a quantity of a dielectric arc-extinguishing fluid, such as $SF_6$ gas or the like. Opening or separation of the interrupting contacts within the $SF_6$ environment permits the interrupting units 14 to interrupt the circuit's magnetizing, load, or fault current flowing therethrough, as is well known.

Each interrupting unit 14 has associated therewith a stored-energy mechanism 18. Each stored-energy mechanism 18 normally biases its associated interrupting contacts to their opened or separated condition. Appropriate latches within the stored-energy mechanism 18 normally prevent the release of the energy; thus, the interrupting contacts are normally maintained closed or engaged. Should it become necessary or desirable to open the interrupting contacts to interrupt current and to open the circuit, the stored-energy mechanisms 18 are appropriately operated to effect rapid separation thereof by the release of the stored energy. The stored-energy mechanisms 18 are of the type that, following opening of the interrupting contacts of their associated interrupting units 14, require further operation to close or re-engage the interrupting contacts and to restore energy to the mechanisms 18 for a subsequent opening operation. Further, the stored energy mechanisms 18 are of the type which may be operated in one of two ways.

Specifically, assuming that the interrupting contacts are closed, such contacts may be opened by manipulation of a manual operating mechanism 20, or by the operation of a shunt-trip controller 22. The manual operating mechanism 20 depends upon manipulation thereof by a human worker or operator in order to effect opening of the interrupting contacts. The shunt-trip controller 22 may be operated by control signals generated by sensors which detect such things as overcurrents or fault currents, transformer overpressure, differential currents, or the like, as well as by remote control signals generated at a control panel or the like. Once the interrupting contacts of the interrupting units 14 have been opened by either the mechanism 20 or the controller 22, only manual manipulation of the manual operating mechanism 22 is effective to close the interrupting contacts and to restore energy to the stored energy mechanisms 18.

The circuit-interrupting device 12 may further include pairs of insulator stacks 24 and 26 which support the interrupting units 14. Specifically, the insulator stacks 24 support, on a horizontal support member 28, the stored-energy mechanisms 18, which are attached to their respective interrupting units 14. The insulator stacks 26 support the other end of the interrupting units 14 on the same support member 28. The insulator stacks 24 beside performing a supporting function are rotatable about their major axes to affect the condition of the stored-energy mechanisms 18 and of the interrupting contacts within the interrupting units 14, as described below.

The shunt-trip controller 22 is electrically connected to shunt-trip solenoid assemblies 30. The shunt-trip solenoid assemblies 30, in turn, control the rotational position of insulated shunt-trip operating shafts 32 connected between the shunt-trip solenoid assemblies 30 and the stored energy mechanisms 18.

The rotatable insulator stacks 24 are connected by appropriate levers and arms (only generally indicated at 33) to an interphase shaft 34 which is horizontally mounted for rotation about its major axis. Appropriate rotation of the interphase shaft 34 simultaneously rotates all three insulator stacks 24 on their major axes via the levers and arms 33 for affecting the condition of the stored-energy mechanisms 18. The interphase shaft 34 is rotated by the rotation of a vertical operating pipe 36 which is connected to the interphase 34 by appropriate couplings, linkages and levers, generally indicated at 37. The operating pipe 36 is in turn rotatable about its major axis by the manual operating mechanism 20. As described more fully in co-pending, commonly assigned U.S. patent application, Ser. No. 923,232, filed July 10, 1978, in the name of Norman J. Stranczek and entitled "Manual Operating Handle Assembly for Circuit Interrupting Devices," the interrupting units 14, the stored-energy mechanisms 18, and the manual operating mechanism 20 have specific operating characteristics.

Assuming the interrupting contacts of the interrupting units 14 to be initially closed or engaged and energy to be stored in the mechanisms 18, the manual operating mechanism 20 may be operated by manual rotation of an operating handle 38. Rotation of the operating handle 38 rotates the operating pipe 36 which causes rotation of the interphase shaft 34 and, ultimately, rotation of the insulator stacks 24 about their major axes. Rotation of the insulator stacks 24 effects the unlatching of the stored-energy mechanism 18 and the release of energy stored therein. This release of energy rapidly separates the interrupting contacts within the interrupting units 14 to interrupt current flowing therethrough. The manual operating mechanism 20 may include an interlock and latch assembly 40 which initially permits only sufficient rotation of the operating pipe 36 by the handle 38 to effect separation of the interrupting contacts. The normal position of the operating pipe 36 is referred to herein as its "home" position; this "home" position may also be referred to as the "ready to trip" position. The rotation of the operating handle 38 and of the operating pipe 36 which effects separation of the interrupting contacts is effected by movement of the vertical operating pipe 36 from its "home" position to a "trip" position. Following this separation of the interrupting contacts, and assuming that the interlock and latch assembly 40 does not permit continued rotation of the operating pipe 36 in the direction which effected opening, the condition of the interrupting contacts and of the mechanisms 18 cannot be further affected. The operating handle 38 may be rotated to cause rotation of the operating pipe 36 between the "trip" and "home" positions without affecting the condition of the interrupting contacts and the mechanisms 18.

The interrupting contacts may also be opened by appropriate energization of the shunt-trip controller 22. As noted previously, the shunt-trip controller 22 may be connected to appropriate sensors or a control panel for effecting separation of the interrupting contacts in response to predetermined circuit conditions or external control signals. Energization of the shunt-trip controller 22 energizes the shunt-trip solenoid assemblies 30. Assuming the interrupting contacts to be closed and energy to be stored in the mechanisms 18, energization of the shunt-trip solenoid assemblies 30 imparts a limited amount of rotation to the shunt-trip operating shafts 32. Limited rotation of the shunt-trip operating shafts 32 unlatches the stored-energy mechanisms 18 and effects the release of stored energy therein. Release of this stored energy opens the interrupting contacts.

It should be noted that, in the structure so far described, separation of the interrupting contacts by operation of the manual operating mechanism 20 has no effect on the shunt-trip controller 22, the shunt-trip solenoid assemblies 30, or the shunt-trip operating shafts 32. Similarly, separation of the interrupting contacts by the shunt-trip controller 22, the shunt-trip solenoid assemblies 30, and the shunt-trip operating shafts 32 has no effect on the manual operating mechanism 20.

Following separation of the interrupting contacts through operation of either the manual operating mechanism 20 or the shunt-trip controller 22, the interrupting contacts may be closed (reset or re-engaged) and energy may be restored in the mechanisms 18 only by appropriate manipulation of the manual operating mechanism 20. Specifically, following separation of the interrupting contacts due to rotation of the pipe 36 to its "trip" position, the operating handle 38 must be rotated in such a way as to move the operating pipe 36 from its "home" position to its "trip" position, (if it is not already in the latter position), and then in the same direction past the "trip" position to a "reset" position. Thus, assuming the interrupting contacts have been initially closed or engaged, movement of the operating pipe 36 from its "home" to its "trip" position effects opening of the interrupting contacts, and further rotation of the operating pipe 36 in the same direction ultimately effects closing or re-engagement of the interrupting contacts as well as the restoration of stored energy to the stored-energy mechanisms 18. Also, assuming the interrupting contacts to have been initially closed, if they are opened by action of the shunt-trip controller 22, initial rotation of the operating pipe 36 from its "home" to its "trip" position has no effect on the interrupting contacts; further rotation of the pipe 36 from the "trip" to the "reset" position closes the interrupting contacts and restores energy to the stored-energy mechanism 18. In either case, the return of the operating pipe 36 from the "reset" position to the "home" position has no further effect on the interrupting contacts.

The interrupting units 14 are of the type which may carry magnetizing and load currents in the circuit, as well as fault currents during circuit interruption, and may, after circuit interruption, withstand full circuit voltage for prolonged periods. The interrupting units 14 are not, however, intended to complete or pick up an energized circuit. Accordingly, the interrupting units 14 are typically connected in series with associated disconnect switches (not shown), one for each interrupting unit 14. It is intended that the interrupting units 14 interrupt the circuit either under load (that is, normal) conditions or fault conditions; typically, the associated disconnect switches do not have a current interrupting rating. Accordingly, these switches are normally closed and the interrupting units 14 are relied upon to interrupt the circuit, if necessary. Once the circuit has been interrupted by operation of the interrupting units 14, the disconnect switches may be opened. Following the opening of the disconnect switches, the interrupting units 14 may be closed or "reset" and energy restored to the mechanisms 18. Resetting the interrupting units 14 must be effected while the disconnect switches remain open because, as noted above, the interrupting units 14 herein involved are not intended to complete an energized circuit. Only after the interrupting contacts of the interrupting units 14 have been closed should the disconnect switches be reclosed. At least two techniques may be employed to effect this sequence of operation of the device 12 and the disconnect switches.

First, the disconnect switches may not be integral with the device 12 and may be operated independently of the interrupting units 14 thereof. In this event, the interlock and latch assembly 40 of the '232 application may be utilized. Specifically, the operating handle 38 may be rotated to rotate the pipe 36 in order to open the interrupting contacts following the removal of a padlock from the interlock and latch assembly 40. Without more, however, the operating handle 38 may not be further rotated to further rotate the operating pipe 36 to close or "reset" the interrupting contacts. Both the disconnect switches and the interlock and latch assemblies 40 contain an interlock mechanism. The interlock mechanism of the assemblies 40 cannot be operated to free the pipe 36 for rotation to the "reset" position until the associated disconnect switches have been opened and a key removed from their interlock. This key cannot be removed from the interlock on the disconnect switches unless such switches are open. Once the associated disconnect switches are open, the key may be removed from the switch interlock and transferred to the interlock of the assembly 40 for unlocking thereof. With the key absent from their interlock, the switches cannot be closed. Manipulation of the interlock of the assembly 40 after it is unlocked permits its operation to free the pipe 36 for further rotation from the "trip" position to the "reset" position. Thus, resetting the interrupting contacts can be affected only when the disconnect switches are open. Similarly, the assembly 40 cannot release the key until the pipe 36 is returned from the "reset" position to at least the "trip" position, after which the assembly 40 must be manipulated to prevent rotation of the pipe 36 to the "reset" position thereby releasing the key. Since the interrupting contacts are now closed (with the switches open), the released key may now be used to permit closure of the disconnect switches. Thus, the conditions imposed by the characteristics of the interrupting units 14 described above are satisfied.

A second type of disconnect switch technique may also be employed. Specifically, each interrupting unit 14 may have integrally associated with its mechanism 18 a disconnect blade (not shown). In this event, the opening and closing movements of the blades are controlled by operation of the mechanisms 18 and 20. Specifically, if the units 14 open due to operation of the controller 22, the position of the normally closed blades is not affected. If the units 14 open due to rotation of the pipe 36 to the "trip" position, the blades, again, remain closed. Following opening of the units 14 in either mode, as the pipe 36 is rotated past "trip" toward "reset," the blades are opened as the insulator stacks 24 rotate, such opening being completed before the units 14 close or are "reset" and energy is restored to the mechanisms 18. Return of the pipe 36 toward the "home" position recloses the blades. In the event such blades are used, the interlock and latch assembly 40 is unnecessary, as proper sequencing of the units 14 and the blades is automatically effected.

For three reasons it is desirable to deactivate the shunttrip solenoid assembly 30 during the time the operating pipe 36 is rotated to reset the interrupting units 14. First, the units 14 cannot operate properly unless the interrupting contacts are closed and full energy is stored in the mechanisms 18, which does not occur until the pipe 36 is rotated fully to "reset." Thus, if the assemblies 30 can be activated before full "reset", circuit interrupting would not occur. Further, since no interruption would occur, the condition calling for interruption would persist, maintaining the controller 22 and the assemblies 30 energized and possibly damaging electrical devices therein which are intended for only momentary energization. Second, if the assemblies 30 can be activated after the units 14 are reset, but before the pipe 36 reaches "trip," the worker may believe the units 14 to be "reset," when indeed they may have opened following resetting. Third, and assuming the pipe 36 again to be between "reset" and "trip" after the units 14 have been "reset," opening of the units 14, with the accompanying release of the high energy stored in the units 18, may apply high mechanical forces to various elements thereby damaging the device 12 or subjecting the worker to unexpected handle rotation. Further, in many use environments, it may be desirable to indicate when the interrupting units 14 are in their "reset" condition; that is, when the interrupting contacts are closed, and to further indicate when the interrupting contacts are opened or in the "tripped" or disengaged condition. To this end, a pair of indicating lamps (shown only generally in FIG. 1), typically, one red and one green, may be used. The red indicating lamp may be lit and the green lamp may be unlit when the interrupting contacts are closed; that is, when the units 14 are conducting current. This condition obtains whenever (a) the pipe 36 is in its "home" position, or (b) the pipe 36 is between its "home" and "trip" positions, but has not reached the "trip" position, and (c) the shunt-trip assembly 30 has not caused the units 14 to open. The green indicating lamp may be lit and the red lamp unlit when the interrupting contacts are open or separated, and resetting of the units 14 has not begun. This condition obtains whenever (a) the pipe 36 is moved to the "trip" position, or (b) the shunt-trip assembly 30 has opened the units 14 and the pipe 36 has not rotated beyond the "trip" position to the "reset" position. Neither lamp may be lit when the operating pipe 36 is between the "trip" and the "reset" positions regardless of the condition of the units 14. Thus, although the units 14 may have been reset, unless the pipe 36 is between "reset" and "home", both lamps are unlit.

The function of the auxiliary switch 10 of the present invention is to effect all of the above ends; namely, the deactivation of the shunt-trip solenoid assembly 30 at predetermined times, and the appropriate illumination of the above described indicating lamps. Specifically, the conditions of the assembly 30 and of the lamps at various times are illustrated in the following table:

| | Assembly 30 | Red Lamp | Green Lamp |
|---|---|---|---|
| Pipe 36 "home"; Units 14 closed | enabled | on | off |
| Pipe 36 "home"; Units 14 open | disabled | off | on |
| Pipe 36 "trip"; Units 14 open | disabled | off | on |
| Pipe 36 between "trip" & "reset"; Units 14 open | disabled | off | off |
| Pipe 36 "reset"; Units 14 closed | disabled | off | off |
| Pipe 36 between "trip" & "reset"; Units 14 closed | disabled | off | off |
| Pipe 36 "trip"; Units 14 closed | disabled | off | off |
| Pipe 36 between "trip" & "reset"; Units 14 closed | enabled | on | off |

Thus, a worker manipulating the handle 38 and viewing the lamps may derive an unequivocal indication of the condition of the units 14 and of the propriety of the handle's position. Whenever the red lamp is lit, the units 14 are closed (and capable of conducting current), the mechanism 18 is able to open the units 14, the assembly 30 is activatable, and the handle 38 is in an appropriate position (release of the energy stored in the mechanism 18 cannot affect the handle 38), whether it is "home" or somewhere between "home" and "trip". Whenever the green lamp is lit, the units 14 are open and the assembly 30 is deactivated; the handle 38 may be left "home" or moved to "trip" (with no effect on the units 14) or moved to "trip" and then to "reset" to close the units 14. Whenever both lamps are unlit, the assembly 30 is deactivated; although the condition of the units 14 is not directly indicated, an indication is given that the position of the handle 38 must be changed (either moved to "reset" and then back past "trip", or, if the units 14 have already been closed, back past "trip"). The auxiliary switch 10 of the present invention may, of course, perform other functions, as will hereinafter be made clear.

The horizontal support members 28 supporting the units 14 of the circuit-interrupting device 12 are themselves supported on a horizontal supporting member 42 which is, in turn, supported on a mounting pedestal 44 or other supporting structure. The mounting pedestal 44 may rest on the ground. If the circuit-interrupting device 12 is supported in the manner depicted in FIG. 1, the interrupting units 14 thereof may well be at a rather substantial height. As a consequence, even though each interrupting unit 14 includes an indicator, generally designated by the reference numeral 46, showing the condition (open or closed) of the internal interrupting contacts, such indicator 46 may not be readily visible from the ground. This is one reason for the inclusion of the indicating lamps discussed above. The entire structure above the horizontal supporting member 42 may be given added rigidity by horizontal tie members 48, which rigidly interconnect the support members 28. A circuit, which the circuit interrupting device 12 is intended to protect, may be connected thereto by way of terminal pads 50 and 52 at either end of the interrupting units 14.

Auxiliary Switch Assembly 10—Structure

Referring to FIGS. 1–3, the auxiliary switch assembly 10 includes a first switch set 100 and a second switch set 102. The condition of the first switch set 100 depends on, or mimics, the rotational position of the operating pipe 36, as set forth more fully below. The condition of the second switch set 102 depends on, or mimics, the condition—open or closed—of the interrupting units 14, as described in detail below. The switch assembly 10 also includes a solenoid 104, the condition of which is determined by the condition of the interrupting units 14. If the interrupting units 14 are opened by the shunt-trip controller 22, the solenoid 104 is energized to change the state of the second switch set 102 without affecting the condition of the first switch set 100. If the interrupting units 14 are opened by the manual operating mechanism 20, the state of the second switch set 102 is changed by the switch assembly 10 without the solenoid 104 being energized. Such opening also changes the state of the first switch set 100. As described earlier, the interrupting units 14 can be reset—closed after opening—only by the manual operating mechanism 20. Such resetting causes the switch assembly 10 to change the state of the second switch set 102 without affecting the energization state of the solenoid 104 and also to change the state of the first switch set 100.

The switch assembly 10 includes a lower support plate 106 and an upper support plate 108 maintained rigidly apart by spacer posts 110 appropriately mounted thereto. The first switch set 100 is mounted to the top of the plate 106; the second switch set 102 and the solenoid 104 are mounted to the top of the plate 108. The plates 106 and 108 and the elements carried thereby are contained in a protective housing 112.

Figure 2A:
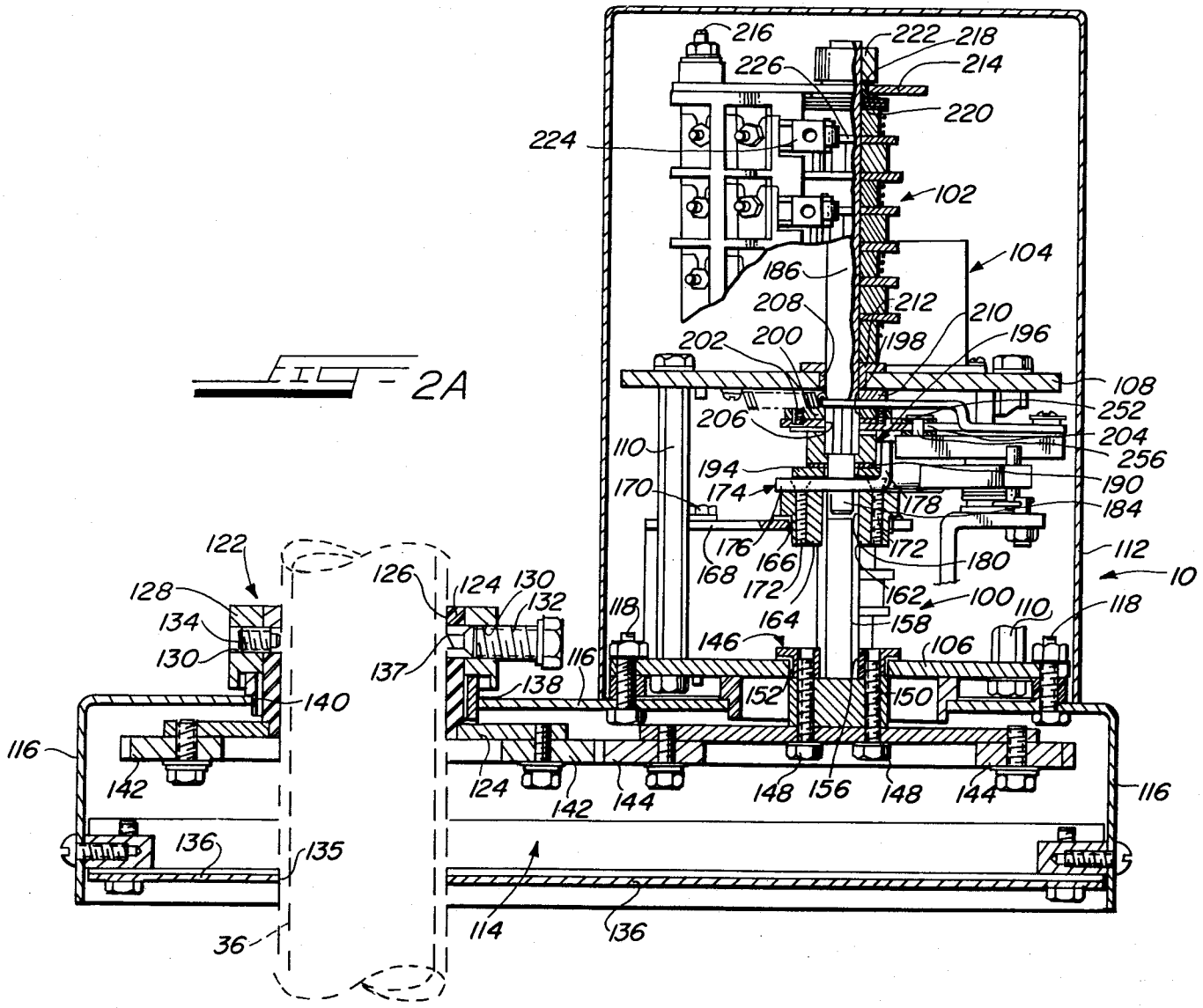
FIG. 2A is a front, partially sectioned elevation of an auxiliary switch according to the present invention which is used with the circuit-interrupting device of FIG. 1.
Figure 3A:
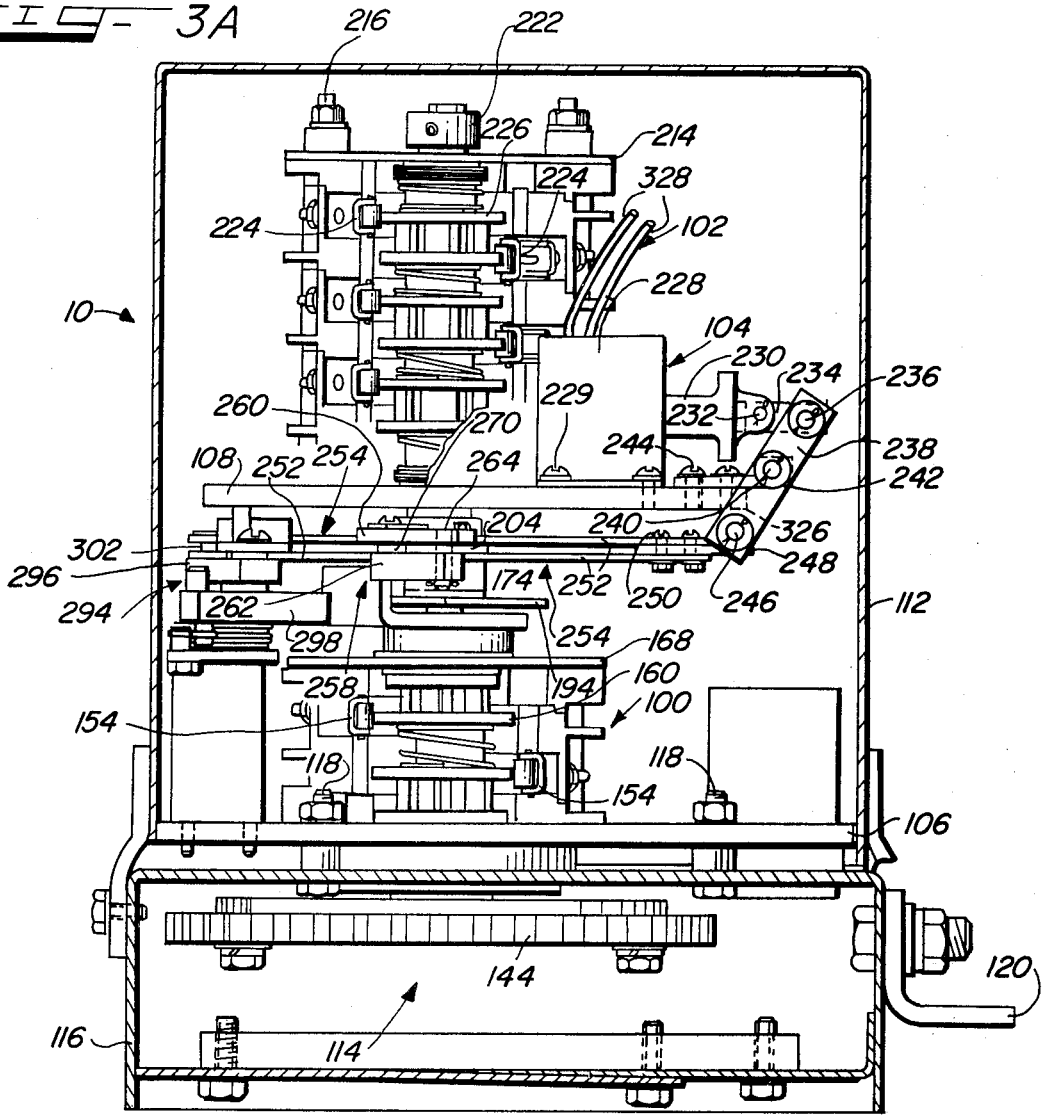
FIG. 3A is a partially sectioned side elevation of the auxiliary switch of FIG. 2.
Figure 3B:
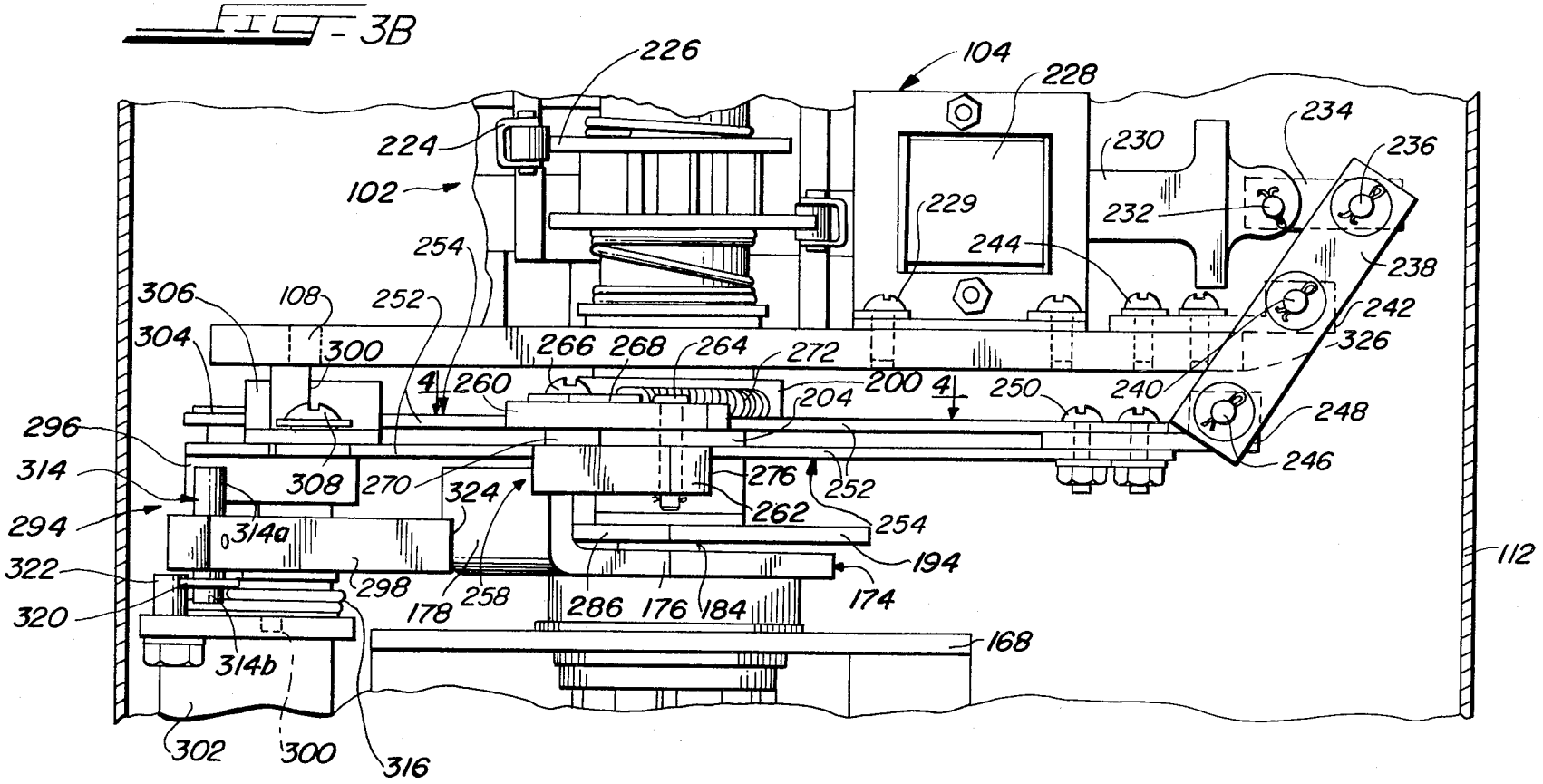
FIG. 3B is an enlarged view of a portion of FIG. 3A.

Referring to FIG. 2A, associated with the switch assembly 10 is a transmission 114 which is contained within a housing 116. The lower plate 106 may be attached by bolts 118 to the housing 116 to fix the switch assembly 10 and the transmission 114 together. The switch assembly 10 and the transmission 114 may be attached in a convenient location to the mounting pedestal 44 for the interrupting device 12 by any convenient means, such as by one or more brackets 120 mounted to the housing 116.

The transmission 114 includes a drive ring assembly 122, through which the operating pipe 36 passes. The drive ring assembly 122 includes a drive ring 124 having a central hole 126 which closely receives the pipe 36. Surrounding the drive ring 124 is a clamping ring 128. The drive ring 124 and the clamping ring 128 include one or more continuous threaded apertures 130 for receiving set screws, such as a piercing set screw 132 or a dog-point set screw 134. After the pipe 36 is passed through both the hole 126 and an aligned hole 135 formed in a support plate 136 to which the housing 116 is attached, the set screws 132 and 134 are rotated inwardly to lock the drive ring assembly 122 to the pipe 36 for rotation therewith. The dog-point set screw 134 achieves this end by friction alone, while a piercing tip 137 of the piercing set screw 132 penetrates the pipe 36 to mechanically lock the pipe 36 to the rings 124 and 128. The drive ring 124 is jounalled for rotation in a bearing 138 on, and passing through, a hole 140 in the housing 116.

Carried by the drive ring 124 within the housing 116 is a first spur gear 142. The spur gear 142 may be mounted to the ring 124 in any convenient fashion. Rotation of the pipe 36, therefore, rotates the spur gear 142.

A second spur gear 144 in mesh with the first spur gear 142 is rotated thereby. The second spur gear 144 is carried by a rotatable bearing assembly 146 and is mounted thereto by bolts 148 threaded into bores 150 in the bearing assembly 146. The bearing assembly 146 is journalled for rotation in an aperture 152 formed in the lower support plate 106.

The first switch set 100 includes one or more contact-operating arms 154 (FIG. 3A) for changing the state—opened or closed—of contacts (not shown) of the individual switches of the first switch set 100. Keyed into a hexagonal socket 156 formed in the top of the bearing assembly 146 is the bottom of a first hexagonal shaft 158. The shaft 158 carries cams 160 (FIG. 3A), which are respectively adjacent the arms 154 for opening or closing the switches of the switch set 100 at selected times as the shaft 158 rotates. Thus, depending on the configuration of the cams 160 and their angular relationship to the shaft 158, the switches of the first switch set 100 and may open and close in any predetermined sequence for selected times in response to rotation of the pipe 36. A preferred sequence and timing scheme for specific embodiments of the present invention are described below.

The top of the shaft 158 is keyed into a hexagonal socket 162 formed in the bottom of a drive hub 164. The drive hub 164 is journalled for rotation in a hole 166 formed in a support plate 168. The support plate 168 rests on top of the first switch set 100, the plate 168 and the switch set 100 being firmly mounted to the lower plate 106 by bolts 170. Attached to the top of the drive hub 164 by screws 172 or the like is a drive lever 174. The drive lever 174 comprises a main body portion 176 abutting and parallel to the top surface of the drive hub 164 and an upwardly extending tang or finger 178. The function of the drive lever 174 is described below. The drive lever 174 and its included tang 178, accordingly, rotate in response to rotation of the pipe 36.

Pressed into a hole 180 in the top of the drive hub 164 is a bushing bearing 182. Extending into the hole 180 and engaging the bushing bearing 182 for relative rotation with respect to the drive hub 164 and the shaft 158 is the rounded end 184 of a second hexagonal shaft 186. The rounded end 184 enters the hole 180 via an aligned hole 188 formed through the drive lever 174.

The rounded end 184 of the shaft 186 also passes through a flanged bushing bearing 190 pressed into an aperture 192 formed through a programming cam 194, which is free to turn on the rounded end 184 relative to the shaft 186. Thus, the shaft 158 (and the drive lever 174), the shaft 186, and the programming cam 194 are all independently rotatable.

Surrounding the upper portion of the rounded end 184 and the lower hexagonal portion of the shaft 186 is a spacer assembly 196. The lower hexagonal portion of the shaft 186 is keyed into a hexagonal hole 198 formed through a hub 200 which may be locked to the shaft 186 against vertical movement by a set screw or groove pin (not shown). Attached to the lower surface of the hub 200 by screws 202 or the like is a lever 204, one end of which is positioned between the spacer assembly 196 and the hub 200. The shaft 186 is keyed through a hexagonal hole 206 formed through the lever 204, the function of which is described below (see also FIG. 4).

The lower portion of the shaft 186 is journalled for rotation in an aperture 208 formed through the upper support plate 108 via a spacer 210 and a flanged bushing 212, the latter being pressed onto the shaft 186 for rotation in the aperture 208 and on the top surface of the upper plate 108. The upper portion of the shaft 186 is held for rotation by a plate 214; between the plate 214 and the upper plate 108, the second switch assembly 102 is clamped by bolts 216 or the like. Specifically, the shaft 186 is journalled for rotation in a hole 218 through the plate 214 via a flanged bearing 220 pressed onto the shaft 186. A lock hub 222 is held on the shaft 186 by a set screw or the like to prevent vertical movement of the shaft 186.

The second switch set 102 includes one or more contact-operating arms 224 for changing the state—opened or closed—of contacts (not shown) of the individual switches of the second switch set 102. The shaft 186 carries cams 226 which are respectively adjacent the arms 224 for opening or closing the switches of the switch set 102 at selected times as the shaft 186 rotates. Thus, depending on the configuration of the cams 226 and their angular relationship to the shaft 186, the switches of the switch set 102 may open and close in any predetermined sequence for selected times in response to rotation of the shaft 186. A preferred sequence and timing scheme for specific embodiments of the present invention are described below.

Figure 2B:
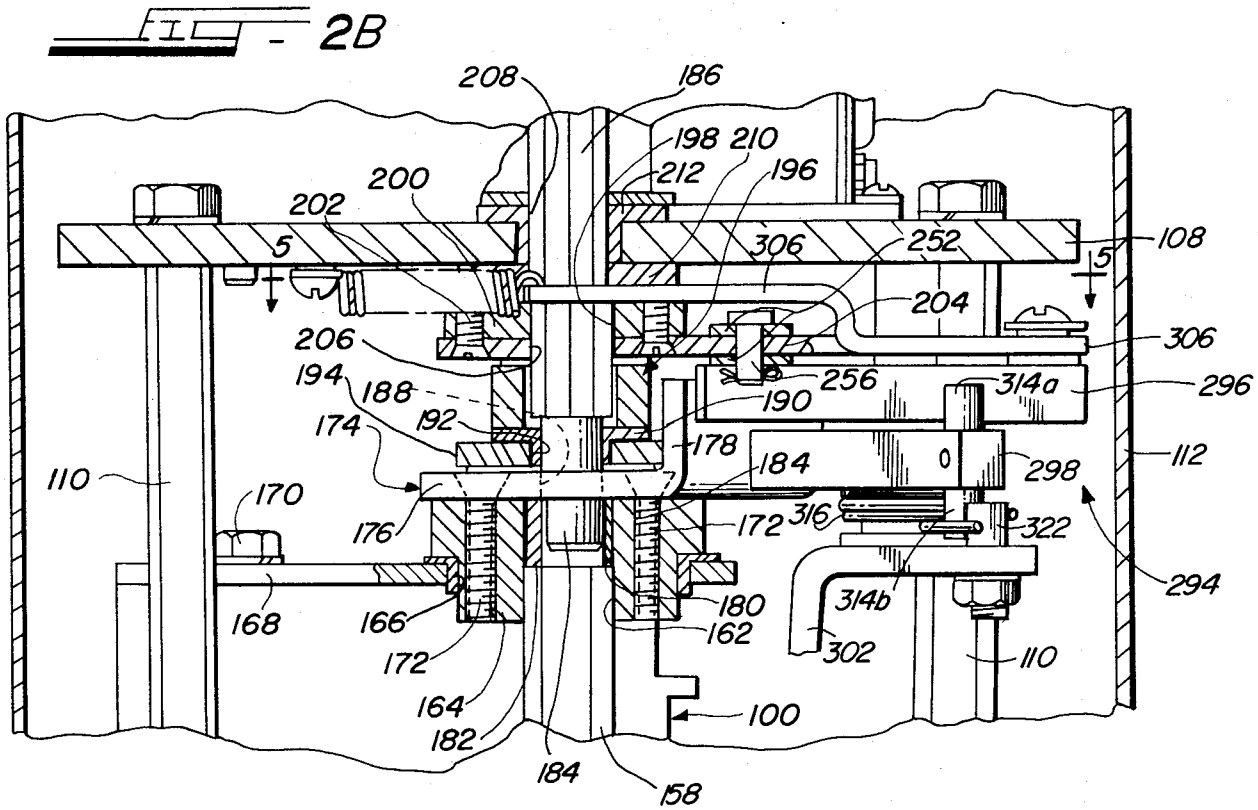
FIG. 2B is an enlarged view of a portion of FIG. 2A.
Figure 4:
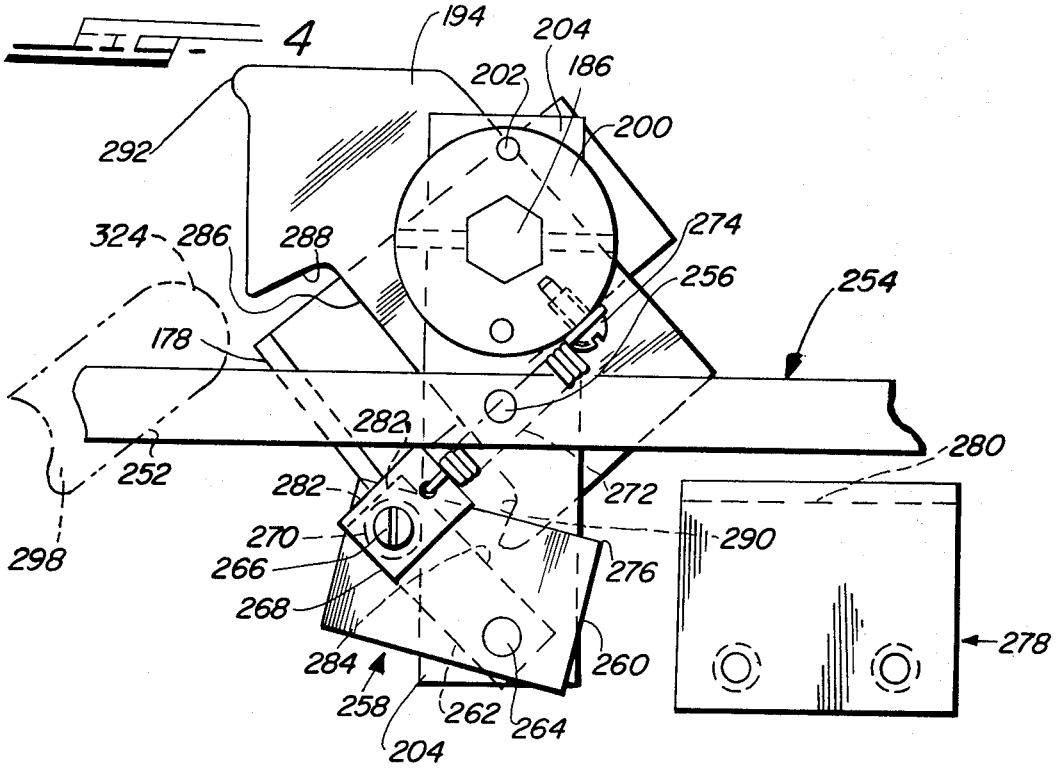
FIGS. 4 and 5 are enlarged top views of some of the elements of the auxiliary switch depicted in FIGS. 3B and 2B, respectively, taken along lines 4 & 5, respectively.

The solenoid 104 includes an energizing coil 228 mounted to the upper plate 108 by screws 229 or the like and an armature 230 movable therein. Energization of the coil 228 pulls the armature 230 thereinto if it is not already therein Pivotally connected by a pin 232 to the free end of the armature 230 is one end of a link 234, the other end of which is pivotally connected by a pin 236 to one end of a link pair 238. The link pair 238 is pivoted generally at its middle by a pin 240 held in a pivot block 242 attached to the upper plate 108 by screws 244 or the like. When the one end of the link pair 238 moves rightwardly, the other end moves leftwardly, and vice versa. Such other end of the link pair 238 is pivotally connected by a pin 246 to a pivot block 248. The pivot block 248 is trapped between and connected to, as by screws 250, first ends of two elongated, parallel arms 252 acting together as a unitary arm assembly 254. The arm assembly 254 passes below the upper plate 108 leftwardly from the link pair 238 as seen in FIG. 3. The middle of the lever 204 is positioned between the arms 252 and is pivotally attached thereto by a pin 256 (FIGS. 2B & 4). Thus, movement of the armature 230 rotates the lever 204 and the shaft 186. Similarly, rotation of the lever 204 both rotates the shaft 186 and moves the armature 230.

The lever 204 carries on its end, remote from its attachment to the hub 200, a latch assembly 258 (FIGS. 3 & 4). The latch assembly 258 includes a latch plate 260 and a latch bar 262. The end of the lever 204 is sandwiched between the latch plate 260 and the latch bar 262 which are pivotally connected to the lever 204 by a pin 264. The latch plate 260 and the latch bar 262 are also locked together as a unitary pivotable structure by a screw 266 or other fastener passing through both thereof. The screw 266 also passes through and locks a spring link 268 to the top of the latch plate 260. The latch plate 260 and the latch bar 262 are maintained apart so as to freely pivot and not bind on the lever 204 by a spacer 270 surrounding the screw 266. A spring 272 is connected between the spring link 268 and a screw 274 or the like threaded into the hub 200. The spring 272 biases the latch assembly 258 in a clockwise direction (FIG. 4) about the pin 264 and attempts to maintain the spacer 270 abutted against an edge of the lever 204, which abutment limits the clockwise rotation of the assembly 258 about the pin 264 relative to the lever 204.

The latch plate 260 defines a pivoting edge or corner 276 at the right thereof. Carried by the underside of the upper plate 108 is a stop member 278 (FIG. 4) which includes a depending arm 280 lying in the path of rotation taken by the pivoting edge 276 as the lever 204 and the latch assembly 258 rotate counterclockwise together about the axis of the shaft 186. The arm 280 also lies in the path of rotation of the lever 204 limiting counterclockwise rotation thereof. The pivoting edge 276 has a normal position somewhat in advance of the leading edge of the lever 204 as counterclockwise rotation of the lever 204 occurs. This normal position of the pivoting edge 276 is achieved by appropriate interrelationship among the size, shape, pivot points, etc., of the lever 204, the latch assembly 258, and the stop member 278, and is ensured by the bias of the spring 272. As the lever 204 rotates counterclockwise, the pivoting edge 276 engages the arm 280. As the lever 204 continues to rotate, the engagement of the pivoting edge 276 with the arm 280 rotates the latch assembly 258 counterclockwise (FIG. 4) relative to the lever 204 on the pin 264 against the bias of the spring 272. Counterclockwise rotation of the latch assembly 258 relative to the lever 204 continues as the lever 204 continues to rotate counterclockwise until the leading edge of the lever 204 abuts the arm 280. The spring 272 then rotates the latch assembly 258 back clockwise, which, due to the engagement of the pivoting edge 276 and the arm 280, forces the lever 204 to rotate clockwise slightly away from the arm 280 until the spacer 270 again abuts the edge of the lever 204.

The latch bar 262 defines a force-receiving surface 282 at the left end thereof. In the normal position of the latch assembly 258, the force-receiving surface 282 lies in the path of rotation of the tang 178 on the drive lever 174 as the drive lever 174 rotates counterclockwise. The latch plate 260 is located above the path of rotation of the tang 178 as is the lever 204.

When the shaft 158 rotates counterclockwise to rotate the drive lever 174 counterclockwise, the tang 178 ultimately engages the surface 282. Further counterclockwise rotation of the shaft 158 causes the tang 178 to apply a counterclockwise rotational force to the surface 282. This force conjointly rotates the latch assembly 258 and the lever 204 counterclockwise about the axis of the shaft 186 to similarly rotate the shaft 186. Counterclockwise rotation together of the tang 178 and the lever 204 continues until the pivoting edge 276 engages the arm 280, at which point the latch assembly 258 begins to rotate counterclockwise relative to the arm 204 on the pin 264, as described above. Counterclockwise rotation of the latch assembly 258 on the pin 264 continues as the tang 178 applies counterclockwise force to the surface 282 until the surface 282 is moved out of the way of the tang 178. At this point, the tang 178 bypasses the latch assembly 258 and counterclockwise rotation of the tang 178 and of the drive lever 174 may freely continue past the latch assembly 258 without further rotation of the shaft 186 or the arm 204. The assembly 258 is returned to its normal position relative to the lever 204 on the pin 264 by the spring 272; the pivoting edge 276 is adjacent the arm 280 and the forward edge of the lever 204 is spaced slightly clockwise from the arm 280.

The latch bar 262 also defines a cam surface 284. After the tang 178 and the drive lever 174 have rotated counterclockwise past (bypassed) the latch assembly 258, the cam surface 284 lies in the path of clockwise rotation of the tang 178. With the latch assembly 258 in its last-described position, if the drive lever 174 is now rotated clockwise, the tang 178 ultimately engages the cam surface 284. Assuming the latch assembly 258 to be held in such last-described position, the engagement between the tang 178 and the cam surface 284 is sufficiently oblique to permit the tang 178 to easily move the latch bar 262 against the spring 272 and out of its way for clockwise rotation of the tang 178 past the latch assembly 258. Thus, counterclockwise rotation of the drive lever 174 rotates the lever 204 counterclockwise, while clockwise rotation of the drive lever 174 by itself has no effect on the position of the lever 204 or the shaft 186.

The programming cam 194, which is freely rotatable independently of the levers 174 and 204, is an elongate member having an elongated notch 286 formed therein. One end of the notch 286 defines a surface 288 which lies in the path of the tang 178 as it and the drive lever 174 rotate clockwise. The other end of the notch 286 defines a surface 290 which lies in the path of the tang 178 as it and the drive lever 174 rotate counterclockwise. The programming cam 194 also defines a cam point 292 which lies on a radius of the cam 194 spaced clockwise from radii defining the surface 288. The function of the cam point 292 is described below.

Figure 5:
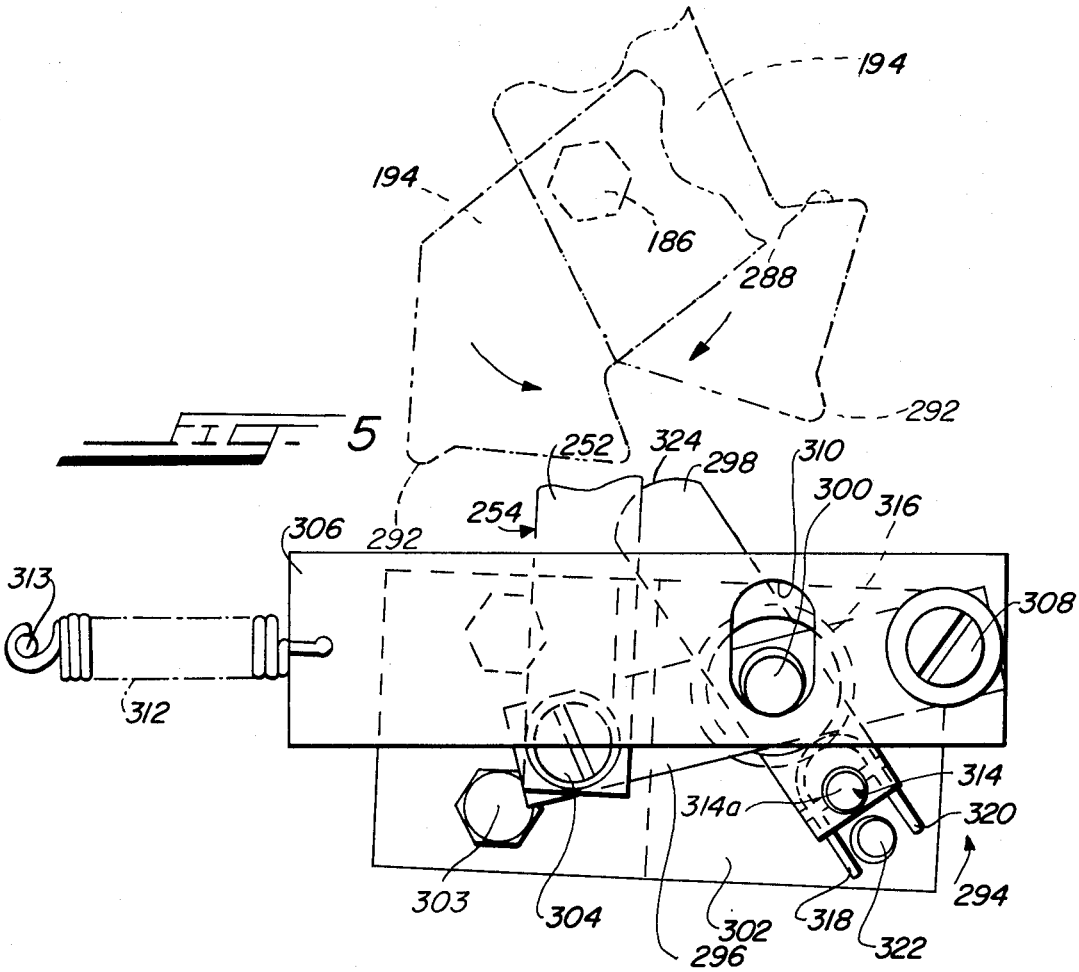
Figure 6:
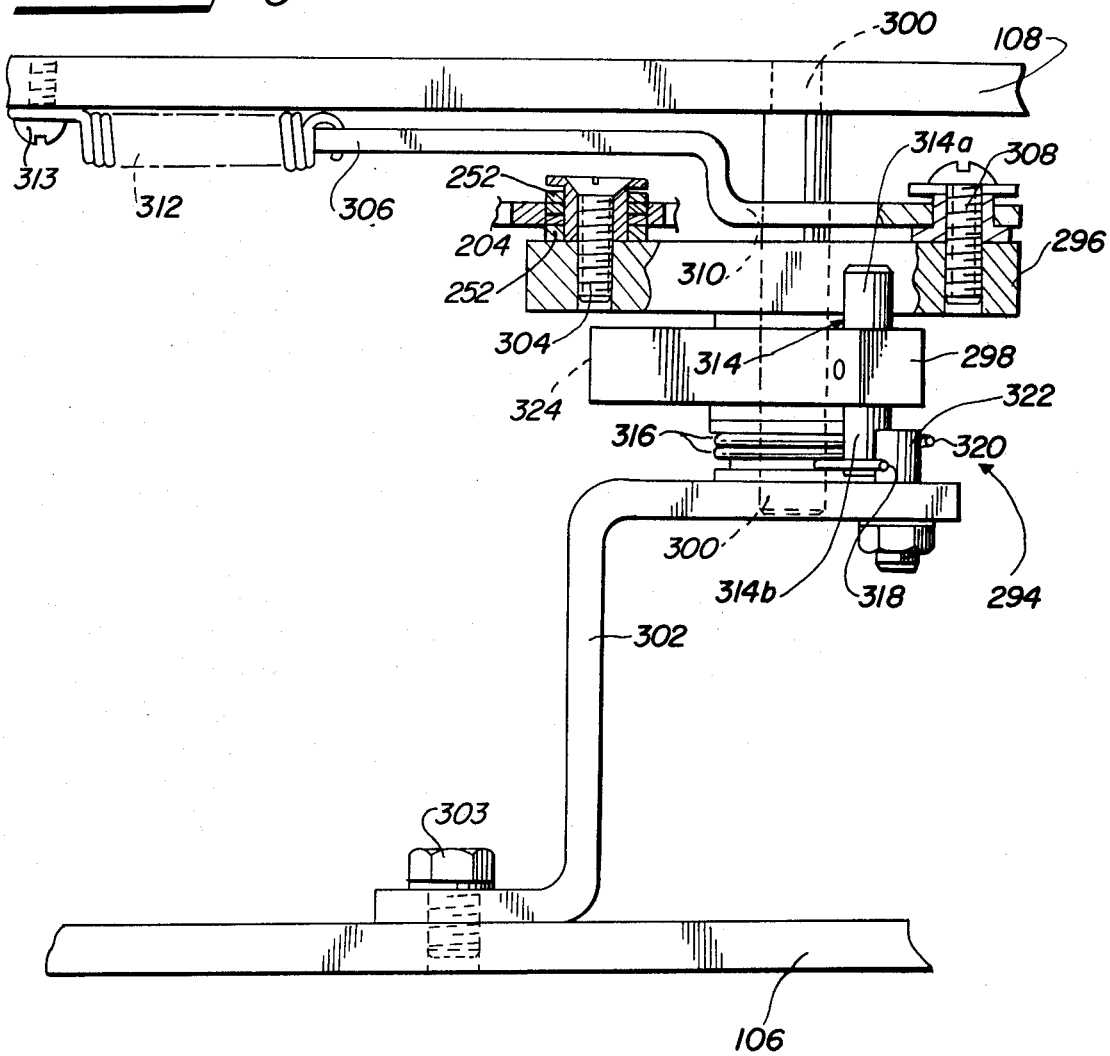
FIG. 6 is a partially sectioned side elevation of some of the elements of the auxiliary switch of FIG. 5.

The end of the arm assembly 254 is attached to a holding assembly 294 (FIGS. 3, 5, & 6). The function of the holding assembly 294 is to hold the arm assembly 254 in a full leftward position or a full rightward position, and to hold the lever 204 and its latch assembly 258 in their full clockwise or full counterclockwise position, respectively. The holding assembly 284 includes a first lever 296 and a second lever 298 commonly pivoted on a pin 300 mounted to a mounting bracket 302 secured to the lower plate 106 by a bolt 303. Both levers 296 and 298 are pivoted on the pin 300 generally at their middles. One free end of the first lever 296 is pivotally connected by a pin, screw of the like 304 to the ends of the two arms 252 of the arm assembly 254. The other free end of the lever 296 is pivotally connected to one end of a spring-connecting member 306 by a pin, screw, or the like 308. The pin 300 is fixed between the bracket 302 and the upper plate 108. The member 306 includes a slot 310 elongated transversely thereof and surrounding the pin 300. The other end of the lever 306 is attached to one end of a spring 312, the other end of which is connected to the upper plate 108 by a screw or pin 313. The spring 312 biases the lever 296 in a direction generally along, but offset from, its axis transverse to the arm assembly 254.

The second lever 298 has one free end in the path of the cam point 292 during rotation of the programming cam 194 in either direction and as set forth herein. The other free end of the lever 298 holds a pin 314, an upper end **314*a* of which extends up into the path of rotation of the first lever 296 and a lower end 314*b* of which extends down, close to the surface of the bracket 302. A coil spring 316 surrounds the pin 300 and has two free ends 318 and 320 extending away from the pin 300 along opposite sides of both the lower pin end 314***b* and a pin 322 fixed to the bracket 302. The spring 316 is so wound that the free end 320 resists clockwise rotation of the second lever 298, and the free end 318 resists counterclockwise rotation thereof. Specifically, when the lever 298 rotates clockwise, the lower end 314*b* of the pin 314 moves the free spring end 318 clockwise, but the pin 322 prevents clockwise rotation of the free spring end 320, thereby biasing the lever 298 back to its initial location. Similarly, when the lever 298 rotates counterclockwise, the pin end 314*b* thereon moves the free end 320 counterclockwise, but the pin 322 prevents counterclockwise rotation of the free spring end 318, thus biasing the lever 298 back to its initial location. In its initial location, the free end of the lever 298 opposite the pins 314 and 322 lies in the patch of the cam point 292 which can clear the lever 298, however, by moving against a rounded end 324 thereof. Specifically, if the cam point 292 is initially to the right of the lever 298 in FIG. 5 and then the programming cam 194 rotates clockwise, the cam point 292 first engages the rounded end 324 and next causes counterclockwise rotation of the lever 298 against the bias of the free end 318 of the spring 316 until the cam point 292 clears the end 324. Following this, the cam point 292 and the cam 194 may freely continue rotating counterclockwise. Similarly, if the cam point 292 is initially to the left of the lever 298 in FIG. 5 and then the cam 194 rotates counterclockwise, the cam point 292 first engages the rounded end 324 and next causes clockwise rotation of the lever 298 against the bias of the free end 320 of the spring 316 until the cam point 292 clears the end 324. Following this, the cam point 292 and the cam 194 may freely rotate clockwise.

The lever 296, the pin 300 on which the lever 296 rotates, the spring-connecting lever 306 and its point of attachment 308 to the lever 296, and the spring 312 all form a spring-biased toggle. Specifically, the lever 296 has two extreme positions, a full clockwise position and a full counterclockwise position in FIG. 5. The armature 230 can assume a full "in" position relative to the coil 228 of the solenoid 104. This full "in" position is leftward in FIG. 3B. When the armature 230 is fully "in" or leftward, the arm assembly 254 is fully rightward (upward in FIG. 5). Due to the connection at 304 of the arm assembly 254 to the lever 296, the full rightward position of the arm assembly 254 sets the full clockwise position of the lever 296. Similarly, the full "out" or rightward position of the armature 230 sets the full leftward position of the arm assembly 254 (downward in FIG. 5) and the full counterclockwise position of the lever 296. Because the spring 312 and the spring-connecting member 306 bias the lever 296 generally along, but offset from, its axis, the lever 296 is maintained in its full clockwise or counterclockwise positions absent some force tending to rotate the lever 296 to the other position. When the lever 296 is in its full clockwise position, the spring 312 exerts a force on the pin 308 biasing the lever 296 for further clockwise movement, which cannot occur because the armature 230 is fully "in." When the lever 296 is in its full counterclockwise position (as shown in FIG. 5), the spring 312 exerts a force on the pin 308 biasing the lever 296 for further counterclockwise movement, which cannot occur because the armature 230 is fully "out."

The end of the lever 296 near the pin 304 is never in the path of any rotating elements, such as the cam 194 and the drive lever 124, including its tang 178. The end 324 of the lever 198 lies only in the path of the cam point 292, as described above. Assuming the lever 296 is in its full counterclockwise position (FIG. 5), rotation of the lever 298 in either direction has no effect on such position, which is maintained by the spring 312. Specifically, should the lever 298 rotate clockwise, the upper end 314*a* of the pin 314 is moved away from the lever 296. Should the lever 298 rotate counterclockwise, the upper pin end 314*a* may ultimately engage the lever 296, but this engagement cannot move the lever 296 as it is in its full counterclockwise position.

Assuming the lever 296 is in its full clockwise position, only counterclockwise rotation of the lever 298 can affect this position. Specifically, should the lever 298 rotate clockwise, the upper pin end 314*a* is again moved away from the lever 296. Should the lever 298 rotate counterclockwise, as by engagement of the rounded end 324 by the cam point 292 when the cam 194 rotates clockwise, the upper pin end 314*a* first engages and then rotates the lever 296 counterclockwise until it is in its full counterclockwise position.

AUXILIARY SWITCH 10—OPERATION

The operation of the switch assembly 10 is now described, beginning with a time at which the interrupting units 14 are normally closed and the operating pipe 36 is in its normal counterclockwise or "home" position. Assuming the handle 38 to be locked with the pipe 36 in its "home" position, the manual operating mechanism 20 is deactivated to prevent rotation of the pipe 36, and the units 14 can be opened only by the controller 22 in response to either an overcurrent in the circuit or a remote operating signal. As explained in greater detail below, if all the interrupting units 14 open, the coil 228 is energized, pulling the armature 230 fully "in."

The normal position of the various elements of the switch assembly 10, when the interrupting units 14 and the pipe 36 are in their assumed normal conditions, is as follows. The individual switches of the first switch set 100 are normally in what is herein called Condition "A." In Condition A, some of the switches of the first set 100 may be open, while other switches thereof may be closed. Upon a predetermined amount of counterclockwise rotation of the shaft 158 and the cams 160 carried thereby, the operating arms 154 are appropriately moved or permitted to move so that the individual switches of the first switch set 100 assume Condition "B." Accordingly, Condition "B" of the first set 100 obtains when the normally opened switches of the first set 100 are closed, and the normally closed switches of the first switch set 100 are open.

The individual switches of the second switch set 102 are normally in Condition "C" wherein some of the switches of the set 102 are open and some are closed. Upon a predetermined amount of counterclockwise rotation of the shaft 186 and of the cams 226 carried thereby, the contact operating arms 224 are moved or are permitted to move to change the state of the individual switches of the switch set 102 from opened to closed and closed to opened. This changed state of the switches of the second switch set 102 is referred to as Condition "D". Accordingly, when the interrupting units 14 and the pipe 36 are in their assumed normal conditions, switch set 100 is in Condition "A" and the switch set 102 is in Condition "C".

The armature 230 of the solenoid 104 is in its full "out" position. Accordingly, the arm assembly 254 is in its full left position (FIG. 3), and the lever 296 is in its full counterclockwise position, being maintained there by the spring 312. The lever 298 is in its normal position whereat the pin 314 is centered between the free ends 318 and 320 of the spring 316. Because the arm assembly 254 is in its full left position, the connection thereof by the pin 256 to the lever 204 maintains such lever 204 in its normal full clockwise position. The latch assembly 258 carried by the lever 204 is also in its full normal clockwise position relative to the axis of the shaft 186. Further, the latch bar 262 and the latch plate 260 are in their full clockwise positions relative to the lever 204 by virtue of the bias of the spring 272. The spacer 270 rests against an edge of the lever 204.

Should some overcurrent condition or remote triggering signal now open all of the interrupting units 14, the coil 228 of the solenoid 104 is energized, pulling the armature 230 leftwardly into the full "in" position. Such movement of the armature 230 pivots the link pair 238 on the pin 240, moving the pin 246 rightwardly. Rightward movement of the pin 246 moves the arms 252 of the arm assembly 254 rightwardly (up in FIG. 5). Rightward movement of the arms 252 accomplishes two ends. First, the lever 204 is rotated counterclockwise. Counterclockwise rotation of the lever 204 rotates the shaft 186 counterclockwise. Counterclockwise rotation of the shaft 186 rotates the cams 226 counterclockwise to change the condition of the switches of the second switch set 102 from Condition "C" to Condition "D". Second, rightward movement of the levers 252 of the lever assembly 254 rotates the lever 296 out of its full counterclockwise position and into its full clockwise position about the pin 300. After the lever 296 passes through its dead-center position, the spring 312 urges the lever 296 into and maintains it in its full clockwise position. The positions of the drive lever 174, of its included tang 178, and of the shaft 158 do not change during this time. Similarly, the programming cam 194 does not move. The switches of the first switch set 100 remain in Condition "A".

The change of the individual swiches of the second switch set 102 from Condition "C" to Condition "D" may affect the condition of any one of a number of devices. Such devices may include indicating devices such as alarms, or the indicating lamps, as well as operating mechanisms for other electrical switches or the like, the condition of which may be required to be changed in response to the opening of the interrupting units 14. It should be noted that if, for some reason, less than all of the interrupting units 14 open, the solenoid 104 will not become energized and the second switch set 102 remains in Condition "C". The full rightward movement of the arms 252 of the arm assembly 254 is set by the impingement of the arm 280 of the stop member 278 with the forward edge of the lever 204.

As noted previously, the interrupting units 14 can be reset, that is, closed after they have been open, only by manual operation of the operating mechanism 20 to rotate the operating pipe 36. Accordingly, at this point, there will be considered the opening of the interrupting units 14 due to rotation of such operating pipe 36.

Again assuming that the switch assembly 10, the interrupting units 14, and the operating pipe 36 are all in their normal positions and conditions, the interrupting units 14 may be opened, as described previously, by appropriate manipulation of the operating mechanism 20. In the specific example hereof, the operating handle 38 of the mechanism 20 is unlocked and is rotated to rotate the pipe 36 from its "home" position to a first position—the "trip" position—in a clockwise direction whereat the interrupting units 14 are opened. Clockwise rotation of the operating pipe 36 rotates its attached spur gear 142 in a clockwise direction. Clockwise rotation of the spur gear 142 rotates the spur gear 144 in a counterclockwise direction. Counterclockwise rotation of the spur gear 144 rotates the shaft 158 in a counterclockwise direction to rotate the drive lever 174 and its included tang 178 also in a counterclockwise direction. At some point during the counterclockwise rotation of the tang 178, it will impinge upon and engage the surface 290 of the notch 286 formed in the programming cam 194. Following such engagement, the programming cam 194 will rotate in a counterclockwise direction along with the drive lever 174.

As the tang 178 rotates counterclockwise, it engages the force-receiving surface 282 on the latch bar 262, as previously described. Further clockwise rotation of the operating pipe 36 causes the tang 178 to apply a counterclockwise force to this surface 282, which effects counterclockwise rotation of the lever 204, as described above. This counterclockwise rotation of the lever 204 continues until the arm 280 of the stop member 278 is engaged first by the pivoting edge 276 of the latch plate 260 and then by the edge of the lever 204 as the tang 178 bypasses the surface 282 of the latch bar 262, all as previously described above. Counterclockwise rotation of the lever 204 rotates the shaft 186 counterclockwise. At approximately the time that the arm 280 of the stop member 278 is engaged by the pivoting edge 276 of the latch plate 260, sufficient counterclockwise rotation of the shaft 186 has occurred to effect a change in the condition of the switches of the second switch set 102 from Condition "C" to Condition "D". In the specific embodiment herein described, this amount of counterclockwise rotation of the drive lever 174 and of the shaft 158 is insufficient to change the condition of the switches of the first switch set 100 from Condition "A" to Condition "B". However, following the bypassing of the surface 282 on the latch bar 262 by the tang 178, sufficient rotation of the shaft 158 is achieved to place the switches of the first switch set 100 into Condition "B".

Thus, at the time when the arm 280 is engaged by the pivoting edge 276, the pipe 36 has reached the first or "trip" position, whereat the interrupting units 14 have been tripped open. If it is desired to return the pipe 36 to its "home" position without resetting the interrupting units 14 at this time, such is achieved by counterclockwise rotation of the pipe 36 due to appropriate rotation of the handle 38, which ultimately results in clockwise rotation of the shaft 158 and of the drive lever 174. This clockwise rotation of the drive lever 174 and of its included tang 178 has no effect on other elements of the switch assembly 10, particularly on the solenoid 104, the armature 230 of which remains in its full "in" position, or on the switch sets 100 and 102.

If it is desired to reset the interrupting units 14, that is, to change them from their opened to their closed condition, immediately following the opening thereof by the controller 22 or the manual operating mechanism 20 as described above, or at some later time, the operating handle 38 is rotated to rotate the pipe 36 in a clockwise direction past the first or "trip" location. Further rotation of the operating handle 38 and counterclockwise rotation of the operating pipe 36 causes additional counterclockwise rotation of the shaft 158. This additional counterclockwise rotation of the shaft 158 and of the drive lever 174 effects the bypassing of the tang 178 with respect to the surface 282 on the latch bar 262, as described above. Also, as described above, at some point after such bypassing, the condition of the switches of the first switch set 100 is changed from Condition "A" to Condition "B".

As described above, the operating pipe 36 must be fully rotated from the first or "trip" location to a second or "reset" location in a clockwise direction to fully reset the interrupting units 14. Anything less than this full additional clockwise rotation will not reset the interrupting units 14. Full clockwise rotation of the operating pipe 36 causes yet additional counterclockwise rotation of the shaft 158. This, of course, causes additional counterclockwise rotation of the drive lever 174 and of its included tang 178. As noted previously, at some point during this counterclockwise rotation, the tang 178 engages the surface 290 of the notch 286 formed in the programming cam 194. Thus, the programming cam 194 is at this time rotating counterclockwise with the drive lever 174. Such counterclockwise rotation of both the drive lever 174 and the programming cam 194 continues until the cam point 292 engages the rounded end 324 of the lever 298. Continued movement of the drive lever 174 and of the cam 194 rotates the lever 298 clockwise due to such engagement against the bias of the free end 318 of the spring 316. Ultimately, the cam point 292 bypasses the lever 298 which returns to its normal position. At the point in time where the cam point 292 bypasses the lever 298, the operating pipe 36 has reached the second or "reset" location, whereat full resetting of the interrupting units 14 has been achieved. The relative position of the various elements of the switch assembly 10 when the operating pipe 36 is in the "reset" position is the same whether the interrupting units 14 were initially opened due to operation of the controller 22 or operation of the manual operating mechanism 20.

If, before the pipe 36 reaches the "reset" position, it is rotated back to the "trip" or "home" position, the switch set 102 is not affected, but the switch set 100 is. Specifically, the cam point 292 will not have bypassed the lever 298 and clockwise rotation of the programming cam 194 by the tang 178 can have no effect on the lever 298. Because the lever 298 will not move, the lever 296 remains in its full clockwise position. Further, the bypassing of the cam surface 284 on the latch bar 262 by the tang 178 does not move the lever 204 due to the spring-toggle effect of the spring 312 on the lever 296.

Assuming now that the cam point 292 has bypassed the lever 298 and is in the "reset" position, it is necessary to return the pipe 36 to its "home" position for future operation of the interrupting units 14. This is achieved by rotating the operating pipe 36 in a counterclockwise direction toward the "home" position. Counterclockwise rotation of the operating pipe 36 rotates the spur gear 142 in a counterclockwise direction. Counterclockwise rotation of the spur gear 142 rotates the spur gear 144 in a clockwise direction. The clockwise rotation of the spur gear 144 rotates the shaft 158 and the operating lever 174 clockwise. This clockwise rotation of the drive lever 174 moves the tang 178 away from the surface 290 of the notch 186 and toward the surface 288 of such notch 186. Ultimately, after the tang 178 engages the surface 288, the programming cam 194 is moved into a clockwise position whereat the cam point 292 engages the rounded end 324 of the lever 298. Continued clockwise rotation of the shaft 158 and the drive lever 174 causes the cam point 292 to rotate the lever 298 in a counterclockwise direction against the bias of the spring 316. Counterclockwise rotation of the lever 298 permits the cam point 292 to bypass the rounded end of 324 and permits free additional clockwise rotation of the shaft 158, the drive lever 174, and the programming cam 194. However, as described previously, counterclockwise rotation of the lever 298, when the lever 296 is in its full clockwise position, engages the upper portion **314*a* of the pin 314 with the lever 296 to rotate such lever 296 out of its full clockwise position and into its full counterclockwise position. Such rotation of the lever 296 into its full counterclockwise position causes full leftward movement of the arms 252 of the arm assembly 254. Full leftward movement of the arms 252 pivots the link pair 238 so that the armature 230 is moved thereby to its full "out" or rightward position. Also, full leftward movement of the arms 252 moves the lever 204 clockwise, rotating the shaft 186 clockwise. Sufficient clockwise rotation of the shaft 186 returns the switches of the second switch set 102 from Condition "D" to Condition "C". Sufficient clockwise rotation of the shaft 158 also returns the switches of the first switch set 100** from Condition "B" to Condition "A".

After the cam point 292 bypasses the lever 298, such lever 298 is returned to its normal position by the spring 216, as described above. It should be noted that at some point in the clockwise rotation of the drive lever 174, the tang 178 bypassed the latch bar 262. As described previously, this bypassing action is easily achieved and has no effect on the position of the lever 204. The position of the lever 204 is affected only by the counterclockwise rotation of lever 298, which causes counterclockwise rotation of the lever 296 to move the lever assembly 254 fully leftwardly. At this point in time, all of the elements of the switch assembly 10 are in their original or normal position, and further cycles of operation of both the interrupting units 14 and of the switch assembly 10 may be achieved as described above.

It should be noted that, if the condition of the switches of the second switch set 102 has been changed from Condition "C" to Condition "D" due to operation of the controller 22, which opened the interrupting units 14, such was achieved by energization of the coil 228 of the solenoid 104. This energization of the solenoid 104, as described above, moves the armature 230 thereof into the full "in" position. Subsequent counterclockwise rotation of the shaft 158 has no effect on this position of the armature 230. Should the condition of the switches of the second switch set 102 be changed from Condition "C" to Condition "D" due, not to operation of the controller 22, but to rotation of the operating pipe 36 by the manual operating mechanism 20, the armature 230 is moved to its full "in" position by the rightward movement of the arms 252 of the arm assembly 254 caused by the impingement of the tang 178 against the latch assembly 258. Thus, whether the condition of the switches of the second switch set 102 was changed due to operation of the controller 22 or of the manual operating mechanism 20, the armature 230 of the solenoid 104 is in the full "in" position. Also, it should be noted that following the armature 230 assuming the full "in" position for either reason, and further following the bypassing of the latch assembly 258 by the tang 178 in the counterclockwise direction, the operating pipe 36 may be moved between the second or "reset" location whereat the interrupting units 14 are reset and the first or "trip" location without affecting the condition of the switches of the second switch set 102. It is only when the operating pipe 36 is moved past the first or "trip" location and toward its "home" location that the condition of the switches of the second switch set 102 is again returned to Condition "C" from Condition "D".

Also, it should be noted, that following the assumption of the armature 230 of its full "in" position, the drive lever 174 may move freely back in a clockwise direction. This means that the operating pipe 36 may be freely moved between the first or "trip" location and its "home" location after the interrupting units 14 have been opened without affecting either the condition of such interrupting units 14 or of the switch sets 100 and 102.

Auxiliary Switch 10—Operation Summary

As described earlier, the switch set 100 responds to the position of the pipe 36. The switch set 100 responds to the condition of the units 14. The programming cam 194 and the latch assembly 258 permit complete independence of the respective conditions of the switch sets 100 and 102. Specifically, if the units 14 are closed, the pipe 36 may be freely rotated between "home" and "trip"; if "trip" is not reached, the units 14 are not affected nor is the switch set 100. If "trip" is reached, and the units 14 open, both switch sets 100 and 102 are affected due both to rotation of the pipe 36 and to movement of the lever 204 by the rotation of the pipe 36. If thereafter the pipe 36 is returned to "home", only the switch set 100 is subsequently affected; the switch set 102 remains in the condition it assumed when "trip" was reached, because the cam point 292 on the cam 194 has not bypassed the lever 298.

If the pipe 36 rotates past "trip", only the switch set 100 can be affected thereby; because of the bypassing of the latch assembly 258 by the tang 178, the switch set 102 is unaffected. If thereafter the pipe 36 is not rotated fully to "reset", the cam point 292 does not bypass the lever 298; return of the pipe 36 to "trip" or "home" can thus affect only the switch set 100; the bypassing of the latch assembly 258 in this reverse direction has no effect on the switch set 102. Only if the pipe 36 is first fully rotated to "reset" does the cam point 292 bypass the lever 298 so that rotation of the pipe 36 past "trip" toward "home" affects the switch set 102; rotation of the pipe 36 also affecting the switch set 100.

Auxiliary Switch 10—Preferred Embodiments

As described earlier, the normal conditions of the switch sets 100 and 102 are "A" and "C", respectively. Referring to the earlier presented table, the normal "A" and "C" conditions and the altered "B" and "D" conditions correspond to the conditions of the table as follows:

| Switch Set 100 | Switch Set 102 | Assembly 30 | Red Lamp 358 | Green Lamp 360 |
|---|---|---|---|---|
| "A" | "C" | enabled | on | off |
| "A" | "D" | disabled | off | on |
| "A" | "D" | disabled | off | on |
| "B" | "D" | disabled | off | off |
| "B" | "D" | disabled | off | off |
| "B" | "D" | disabled | off | off |
| "B" | "D" | disabled | off | off |
| "A" | "C" | enabled | on | off |

Figure 7:
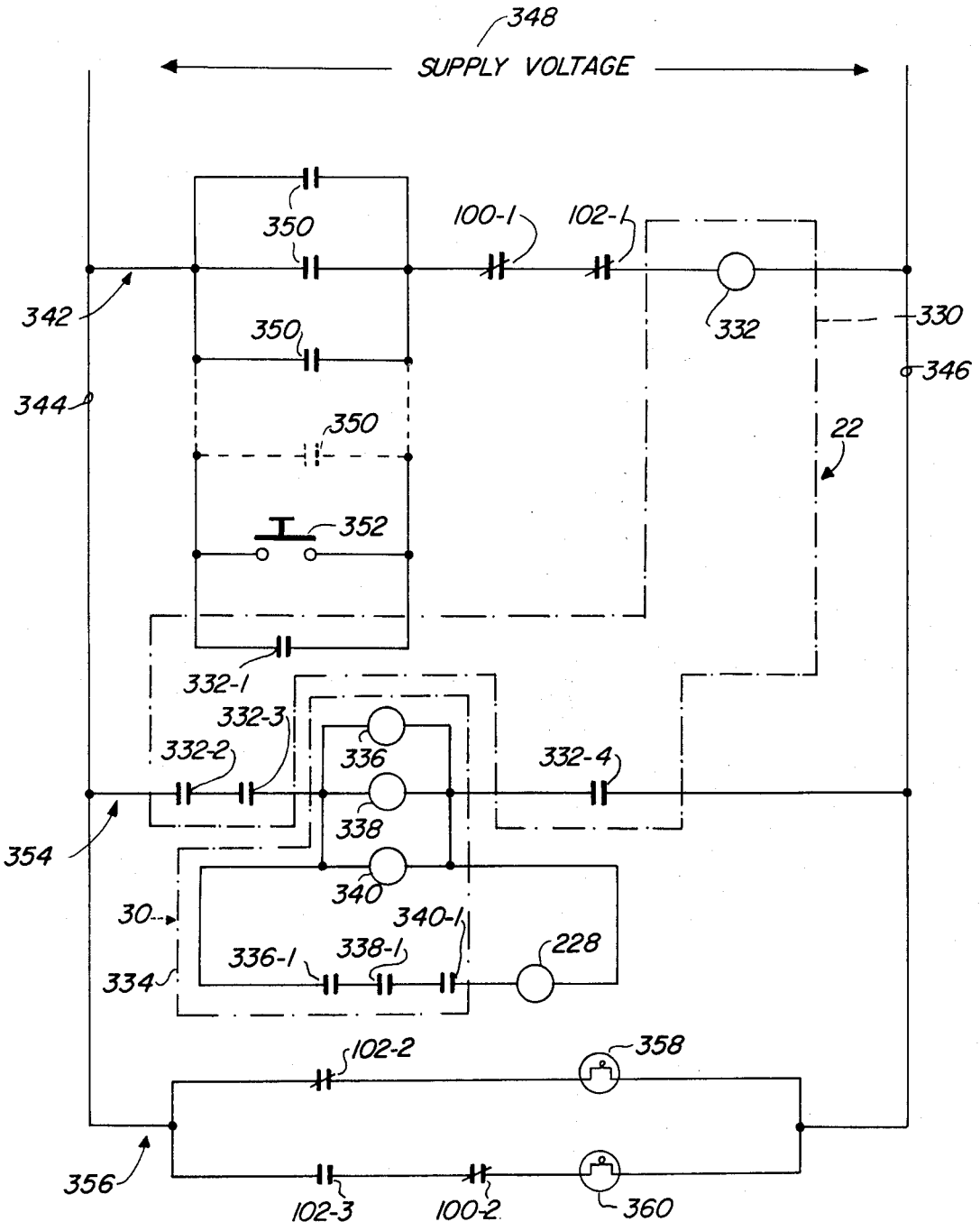
FIG. 7 is a schematic electrical diagram of certain portions of the circuit-interrupting device of FIG. 1 and of the auxiliary switch of FIGS. 2–6.

Referring now to FIG. 7, there is shown a schematic diagram which achieves the preferred embodiment of the present invention.

Located in the controller 22 is a contactor 330 which includes a coil 332 and normally open contact pairs 332-1, 332-2, 332-3, and 332-4 operated thereby. Located in each of the assemblies 30 is a trip solenoid 334 (which have been depicted together in a single dashed outline labeled 334). The trip solenoids 334 include respective coils 336, 338, and 340 and a normally open contact pair 336-1, 338-1, and 340-1 operated thereby.

A first branch 342 is connected between lines 344 and 346 connected to a source 348 of supply voltage, such as 120 or 240 vac. The first branch 342 includes a serial combination of a normally closed contact pair 100-1 of the first switch set 100, a normally closed contact pair 102-1 of the second switch set 102, and the coil 322 of the contactor 330. In series with this serial combination may be a parallel combination of one or more normally open contact pairs 350, a normally open control switch 352, and the normally open contact pair 332-1. The contact pairs 350 may be controlled by remote sensors of any type, such as those responsive to overpressures in a transformer in the circuit, differential current relays, or the like. If no untoward conditions occur in the circuit or transformer, the contact pairs 350 remain open. The contact pairs 350 close in response to such untoward conditions. The switch 352 may be located on the controller 22 or in a remote location. If the former, one of the contact pairs 350 may be at a remote location. If the contact pairs 100-1 and 102-1 are closed and any contact pair 350 or the switch 352 closes, the coil 332 is energized by the source 348. Such energization closes the contact pairs 332-1 through 332-4. The contact pair 332-1 is a latch for the coil 332; once the coil 332 is energized, the contact pair 332-1 maintains it energized until one of the contact pairs 100-1 or 102-1 opens.

A second branch 354 in parallel with the first branch 342 includes a serial combination of the contact pairs 332-2, 332-3, and 332-4. In series with this serial combination is a parallel combination of (a) the solenoid coils 336, 338, and 340 all in parallel, and (b) a serial combination of the contact pairs 336-1, 338-1, and 340-1 and the coil 228 of the solenoid 104. If all three contact pairs 332-2, 332-3, and 332-4 close, the coils 336, 338, and 340 become energized to close their contacts 336-1, 338-1, and 340-1, closure of all three of which energizes the coil 228 from the source 348.

A third branch 356 in parallel with the branches 342 and 354 includes two parallel paths. One path includes a serial combination of a normally closed contact pair 102-2 of the switch set 102 and a red lamp 358. The other path includes a serial combination of a normally open contact pairs 102-3 of the switch set 102, a normally closed contact pair 100-2 of the switch set 100, and a green lamp 360. The red lamp 358 lights if the contact pair 102-2 is closed; the green lamp 360 lights if both contact pairs 102-3 and 100-2 are closed.

With the pipe 36 "home" and the units 14 closed, all of the contact pairs are in their normal conditions. The coils 228, 332, 336, 338, and 340 are de-energized. The red lamp 358 is lit (because the contact pair 102-2 is closed) and the green lamp 360 is unlit (because the contact pair 102-3 is open). This condition of the lamps 358 and 360 informs that the units 14 are closed but may be tripped open because full energy is stored in the mechanisms 18.

Assuming that the units 14 are now called upon to interrupt the circuit via operation of the controller 22, one of the contact pairs 350 or the switch 352 momentarily closes. Closure of the contact pairs 350 or the switch 352 energizes the coil 332. Energization of the coil 332 closes the contact pair 332-1, to latch the coil 332 energized, and closes the contact pairs 332-2, 332-3, and 332-4. Closure of the contact pairs 332-2, 332-3, and 332-4 energizes the coils 336, 338, and 340. Energization of the coils 336, 338, and 340 effects two ends. First, the shunt-trip operating shafts 32 are rotated to release the energy from the mechanisms 18. This energy release opens the interrupting units 14. Second, the coil 228 of the solenoid 102 is energized. This pulls the armature 230 fully "in" and changes the second switch set 102 from "C" to "D". The change of the switch set 102 to "D" opens the contact pairs 102-1 and 102-2 and closes the contact pair 102-3. Opening the contact pair 102-1 de-energizes the coil 332, which until this time was latched in the energized state by the contact pair 332-1. Opening of the contact pair 102-2 extinguishes the red lamp 358. Closing of the contact pair 102-3 lights the green lamp 360. The de-energization of the coil 332 opens the contact pairs 332-1 through 332-4, the opening of the latter three of these pairs de-energizing the coils 336, 338 and 340 to open the contact pairs 336-1, 338-1, and 340-1 and to de-energize the coil 228. Because the contact pair 102-1 cannot reclose (switch set 102 cannot return to Condition "C") until the pipe 36 is fully rotated to the "reset" position and then rotated past "trip" toward "home", the units 14 cannot be called on to operate until this same time. The condition of the lamps 358 and 360 indicates the units 14 are open and that resetting is not in progress.

If the units 14 are opened by rotation of the pipe 36 to "trip", the tang 178 moves the lever 204 to change the switch set 102 to Condition "D", but the switch set 100 is not affected, as described above. With the switch set 102 in Condition "D", the red lamp 358 is unlit; the green lamp 360 is lit, and the coil 332 is incapable of becoming energized.

Following opening of the units 14 by either the controller 22 or rotation of the pipe 36, the units 14 may be reset with the following consequences. After the pipe 36 bypasses the "trip" position and the tang 178 bypasses the latch assembly 258, the cams 160 on the shaft 158 now change the switch set 100 to assume Condition "B."

In Condition "B" of the switch set 100, both contact pairs 100-1 and 100-2 open, the former doubly insuring that the coil 332 cannot be energized (the contact pair 102-1 is already open) and the latter extinguishing the green lamp 360. Both lamps 358 and 360 being extinguished informs that whatever the condition—open or closed—of the units 14, they cannot be tripped and the position of the handle is inappropriate. After the pipe 36 is rotated fully to the "reset" position and the units 14 are closed, the pipe 36 may be rotated to and past "trip" toward "home". Only after such occurs do the switch sets 100 and 102 revert to Conditions "A" and "C", respectively, permitting the coil 332 to again be energized, lighting the red lamp 358 and keeping the green lamp 360 unlit.

ALTERNATIVE EMBODIMENTS

In the preferred embodiments, the switch 10 is used with a device 12 associated with a remote disconnect switch. The interlock and latch assembly 40 of the '232 application is also used. Thus, when both lamps 358 and 360 are unlit, the operator knows that the pipe 36 must be returned to at least the "trip" position from the "reset" position; he also knows that the disconnect switch is open because, for the pipe 36 to be so positioned, the assembly 40 must have been operated, which in turn required opening of the disconnect switch and the release of the key from the interlock thereof. When the device 10 includes integral disconnect blades operated by movement of the handle 38, no such indication of the two unlit lamps 358 and 360 is necessary. In this event, the contact pair 100-2 may be eliminated. Accordingly, the green lamp 360 is lit whenever the pipe 36 is between "trip" and "reset" because the disconnect switch is opened during this time; here, the lighting of the green lamp 360 informs that the units 14 carry no current because the units 14 are open, or the disconnect blades are open, or both.

Also, the switch sets 100 and 102 may be used to control the operation of disconnect switches remote from the interrupting units 14. Specifically, contact pairs of the switch sets 100 and 102 may energize a motor operator for the remote disconnect switch to open the switch after the units 14 have opened and to close the switch after the units 14 are closed and the shaft 36 is between "reset" and "home."

It has been assumed above that opening and resetting of the interrupting units 14 is achieved by clockwise rotation of the handle 38 and of the operating pipe 36 as viewed from above the device 12. If the interrupting units 14 are to be tripped open and then reset by counterclockwise rotation of these elements, the same auxiliary switch 10 may be used without any change except that of its mounting. Specifically, in this event, the switch assembly 10 is mounted upside-down from the orientation depicted in FIG. 1 so that counterclockwise rotation of the pipe 36 and of the spur gear 142 appropriately rotates the spur gear 144 to achieve the above described operating cycles.

Conclusion

The device 12 is at line or bus potential. The switch assembly 10 is at ground potential. Notwithstanding the difference in potential between the two, the switch assembly 10 mimics, in a single, unified assembly, the putative condition of the interrupting units 14 and the condition of the pipe 36. The switch set 102—which is mechanically operated by the ground potential pipe 36—mimics and gives an indication of the condition of the pipe 36 independent of the condition of the units 14. The switch set 100—which is mechanically operated by the ground potential pipe 36, or is electrically operated by the ground potential controller 22 and assemblies 30—gives an indication of the putative condition of the interrupting units 14. The word "putative" is used because the switch set 100 does not directly respond to the condition—open or closed—of the units 14; if it did, it could not be maintained at ground potential. Rather, the switch set 100 is affected by either (a) movement of the pipe 36 which should open or close the units 14, or (b) operation of the controller 22 which should open the units 14.

We claim:

1. Apparatus for indicating the condition of an interrupting device connectable to a high-voltage circuit, the interrupting contacts of the device being openable to prevent current flow therethrough; a first, stored-energy mechanism for biasing the contacts open whey they are closed, the first mechanism re-storing contact-opening energy when the contacts are moved from open to closed; a second, shunt-trip mechanism which operates in response to either electrical conditions of the circuit or a remote command to release the stored energy for opening the contacts; a third mechanism which operates in response to manual movement thereof to release the stored energy for opening the contacts and which also operates in response to manual movement thereof to close the contacts following opening thereof by either the second or third mechanism; operation of the second or third mechanism not affecting the condition of the other mechanism; the indicating apparatus comprising:

means at ground potential for mimicing the putative condition of the contacts depending on the condition of the second and third mechanisms, for mimicing the movement of the third mechanism, and for thereby indicating the condition of the interrupting device, the mimicing means comprising first means responsive to the lack of contact-opening operation of the second and third mechanisms for giving a first sensible indication that the contacts are putatively closed;

second means responsive to the contact-opening operation of either the second or third mechanism for giving a second sensible indication that the contacts are putatively open; and third means responsive to contact-closing operation of the third mechanism for giving a third sensible indication that such operation is taking place.

2. Apparatus as in claim 1, wherein following completion of the contact-closing operation of the third mechanism, the first indication is given and the second and third indications are not given.

3. Apparatus as in claim 2, wherein the first, second and third means together include a pair of bistable devices the first indication being characterized by the first bistable device being in a first state, and the second bistable device being in a second state; the second indication being characterized by the first bistable device being in its second state, and the second bistable device being in its first state; the third indication being characterized by both bistable devices being in their second states.

4. Apparatus as in claim 3, wherein the bistable devices give an observable indication of their respective states and are observable from the vicinity of the third mechanism.

5. Apparatus as in claim 1,2,3 or 4, which further comprises fourth means for enabling the second mechanism when the first indication is given and for disabling the second mechanism when the second or third indication is given.

6. Apparatus for indicating the condition of a high-voltage circuit interrupting device; the circuit interrupting device being of the type having: normally closed, movable interrupting contacts which are openable to interrupt circuit current flowing therethrough; a first, stored-energy mechanism for biasing the contacts open when they are closed, the first mechanism storing contact-opening energy when the contacts are moved from open to closed; a second, shunt-trip mechanism for releasing the stored energy to open the contacts in response to either electrical conditions of the circuit or a remote command; a third, manually operable mechanism movable out of a home position to a trip position in a first direction for releasing the stored energy to open the contacts, and further movable in the first direction to a reset position to close the contacts following opening thereof by either the second or third mechanism, movement of third mechanism in a second opposite direction back to its home position not moving the contacts; operation of the second or third mechanism not affecting the other mechanism; wherein the indicating apparatus comprises:

first means responsive to the contacts being closed and the third mechanism being either in its home position or between its home and trip positions for giving a first sensible indication thereof;

second means response to (a) the contacts being opened by the second or third mechanism and (b) the third mechanism being in either its home or its trip position for giving a second sensible indication thereof; and third means response to the third mechanism being either between its trip and reset positions or at its reset position for giving a third sensible indication thereof.

7. Apparatus according to claim 6, wherein the three means together include a pair of digital indicators, each having an on state and an off state, once indicator being on and the other indicator being off to produce the first sensible indication, the one indicator being off and the other indicator being on to produce the second sensible indication, both indicators being off to produce the third sensible indication.

8. Apparatus according to claim 7, wherein the indicators are near, and observable from the vicinity of, the third mechanism.

9. Apparatus according to claim 6, which further comprises fourth means for enabling the second mechanism when the first indication is given and for disabling the second mechanism when the second or third indication is given.

10. Apparatus according to claim 6, wherein the three means comprise a first electrical branch having a first switch which is closed when the contacts are closed and open when the contacts are open, a first indicator in series with the first switch, the first indicator being on when the first switch is closed and off when the first switch is open; and a second electrical branch in parallel with the first branch and having a second switch which is open when the contacts are closed and closed when the contacts are open, a third switch which is closed when the third mechanism is either its home position or between its home and trip positions and which is open in all other position of the third mechanism; and a second indicator in series with the second and third switches, the second indicator being on when both switches are closed and off when either switch is open.

11. Apparatus according to claim 10, which further comprises fourth means for enabling the second mechanism when the first indication is given and for disabling the second mechanism when the second or third indication is given.

12. Apparatus according to claim 11, wherein the fourth means comprises a fourth switch which is closed when the contacts are closed and open when the contacts are open, and a fifth switch which is closed when the third mechanism is in its home position of the third mechanism, the fourth and fifth switches being serially connected to the second mechanism to enable the second mechanism when both are closed and to disable the mechanism when either is open.

13. Apparatus for indicating the condition of a high-voltage circuit-interrupting device; the circuit-interrupting device being of the type having: normally closed, movable interrupting contacts which are openable to interrupt circuit current flowing therethrough; a first, stored-energy mechanism for biasing the contacts open when they are closed, the first mechanism storing contact-opening energy when the contacts are moved from open to closed; a second, shunt-trip mechanism for releasing the stored energy to open the contacts in response to either electrical conditions of the circuit or a remote command; a third, manually operable mechanism movable out of a home position to a trip position in a first direction for releasing the stored energy to open the contacts, and further movable in the first direction to a reset position to close the contacts follwing opening thereof by either the second or third mechanism, movement of third mechanism in a second opposite direction not moving the contacts; operation of the second or third mechanism not affecting the other mechanism; wherein the indicating apparatus comprises:

a movable member normally in a first location;

first means for providing a first signal when the member is in its first location and for providing a second signal when the member is moved out of its first location;

second, electro-mechanical means for moving the movable member out of its first location in response to opening of the contacts by the second mechanism;

third mechanical means for moving the movable member out of its first location in response to movement in the first direction of the third mechanism from its home position to its trip position, movement of the third mechanism between its home and trip positions after movement of the member out of its first location by the second or third means but before movement of the third mechanism to its reset position not affecting the location of the member, movement of the third mechanism between its trip and reset positions after movement of the member out of its first location by the second or third means not affecting the location of the member, and movement of the third mechanism in the opposite direction from its trip position to its home position after residing in its reset position returning the member to its first location;

fourth means for providing a third signal when the third mechanism is either in its home position or between its home and trip positions and for providing a fourth signal in all other positions of the third mechanism.

14. The apparatus of claim 13, wherein the movable member and the first means comprise a rotatable shaft having an arm thereon which is normally in the first location;

a cam on the shaft;

a switch operated by the cam; and means for coupling the arm to both the second and third means for rotation thereby.

15. The apparatus of claim 13, wherein the fourth means comprises a rotatable shaft;

a cam on the shaft;

means for rotating the shaft in response to movement of the third mechanism; and a switch operated by the cam.

16. The apparatus of claim 14 or 15, wherein the second means comprises a solenoid having a movable armature and a coil which is energizable in response to opening of the contacts to pull the armature fully thereinto from a full out condition;

the third means comprises a drive lever rotatable with the third mechanism, and the coupling means comprises link means mechanically connected between the armature and the arms so that movement of the armature rotates the arm and rotation of the arm moves the armature, energization of the coil when the arm is in its first location and the armature is fully out rotating the arm out of the first location, rotation of the arm out of its first location moving the armature from fully out to fully in without energization of the coil, rotation of the arm into its first location moving the armature from fully in to fully out;

latch means on the arm (a) for permitting the drive lever to rotate the arm out of its first location when the third mechanism moves from its home position to its trip position before energization of the coil, (b) for permitting the drive lever to bypass the arm when the third mechanism moves from its trip position to its reset position after the arm has been rotated out of its first location by either the drive lever or the armature, and (c) for permitting the drive lever to bypass the arm when the third mechanism moves from its reset position to its home position, and holding means on the link means for rotating the arm to its first location during rotation of the drive lever in response to movement of the third mechanism from its trip position to its home position after the drive lever has bypassed the arm during movement of the third mechanism from its trip position to its reset position.

17. The apparatus of claim 16, wherein the latch means comprises a body on the arm rotatable therewith and independently rotatable thereon;

a surface on the body for receiving force from the drive lever to rotate the arm;

a pivoting edge on the body, and a stationary stop member in the rotational path of the pivoting edge, rotation of the arm by the drive lever due to movement of the third mechanism in the first direction ultimately causing the pivoting edge to engage the stop member whereupon the body rotates on the arm to allow the drive lever to bypass the force-receiving surface and the body as the third mechanism moves toward the reset position.

18. The apparatus of claim 17, wherein the surface receives arm-rotative force only if the arm is in its first location and the third mechanism is in its home position before the drive lever begins to rotate toward its trip position, the body defines a cam surface in the rotative path of the drive lever which cam surface is obliquely impinged on by the drive lever as the third mechanism moves from its reset to its home position to permit the drive lever to bypass the body, and the latch means further comprises means for biasing the body to a normal position before the drive lever bypass the body due to movement of the third mechanism in either direction.

19. The apparatus of claim 16, wherein the holding means comprises cam means independently rotatable from the arm and the drive lever, the cam means, the arm, and the drive lever rotating on a common axis;

a cam point on the cam means;

a first lever pivotable in either direction on a pin, one end of the first lever being in the rotative path of the cam point and the other end thereof carrying a thrust member;

means for biasing the first lever into a normal position, the first lever momentarily pivoting out of the normal position as the cam point engages and then bypasses the one end thereof;

means on the cam means engageable by the drive lever as the drive lever rotates for rotating the cam means and the cam point in a first direction as the third mechanism moves in its first direction past its trip position and to rotate the cam means and the cam point in a second direction as the third mechanism moves in its second direction past its trip position, the thrust member pivoting in a first direction or a second direction as the cam point rotates past the one end of the first lever in its first direction or its second direction;

a second, two-position lever pivotable in either direction on the pin, one end of the second lever being connected to the link means so that movement of the armature or rotation of the arm pivots the second lever and pivoting of the second lever rotates the arm and moves the armature, the other end of the second lever being in the pivoting path of the thrust member so that when the first lever rotates in its second direction at a time when the armature is fully in, the thrust member pivots in its second direction to pivot the second arm so that the link means is moved to move the armature fully out and to rotate the arm to its first location; and means for biasing the second lever to its two positions, the biasing means and the second lever forming an overcenter toggle.

20. Apparatus for indicating the condition of a circuit-interrupting device; the circuit-interrupting device being of the type having: movable, normally closed contacts which are openable to interrupt current in a high-voltage circuit to which the device is connected; a first, stored-energy mechanism for biasing the contacts open when they are closed, the first mechanism storing contact-opening energy when the contacts are moved from open to closed; a second shunt-trip mechanism for releasing the stored energy to open the contacts in response to either electrical conditions of the circuit or a remote command; a third, manually operable mechanism movable out of a home position to a trip position in a first direction for releasing the stored energy to open the contacts, and movable in the first direction from the trip position to a reset position to close the contacts following opening thereof by either the second or third mechanism, movement in a second opposite direction not moving the contacts; operation of the second or third mechanism having no effect on the condition of the other mechanism, wherein the apparatus comprises;

a movable member normally in a first location;

first means for providing a first signal when the member is in the first location and for providing a second signal when the member is out of the first location;

second means for moving the movable member out of the first location in response to opening of the contacts by the second mechanism;

third means responsive to movement in the first direction of the third mechanism out of its home position to its trip position for moving the movable member out of its first location;

fourth means for providing a third signal when the third mechanism is in its home position or between its home and trip positions and for providing a fourth signal in all other positions of the third mechanism; and fifth means responsive to the signals for providing an indication of the condition of the circuit interrupting device contacts and of the position of the third mechanism.

* * * * *